US005670973A

United States Patent [19]

Bassetti, Jr. et al.

[11] Patent Number: 5,670,973

[45] Date of Patent: Sep. 23, 1997

[54] METHOD AND APPARATUS FOR COMPENSATING CROSSTALK IN LIQUID CRYSTAL DISPLAYS

[75] Inventors: Chester Floyd Bassetti, Jr., Pleasanton; Chin-Hsian Chang, Milpitas; Vlad Bril, Campbell; Rakesh Kumar Bindlish, San Jose, all of Calif.

[73] Assignee: Cirrus Logic, Inc., Fremont, Calif.

[21] Appl. No.: 743,413

[22] Filed: Nov. 1, 1996

Related U.S. Application Data

[63] Continuation of Ser. No. 342,783, Nov. 21, 1994, abandoned, which is a continuation of Ser. No. 43,001, Apr. 5, 1993, abandoned.

[51] Int. Cl.[6] ..... G09G 3/36

[52] U.S. Cl. ..... 345/58; 345/101; 345/100

[58] Field of Search ..... 345/58, 87, 89, 345/98, 94, 99, 100, 101, 90; 349/54, 75, 192

[56] References Cited

U.S. PATENT DOCUMENTS

| | | | |
|---|---|---|---|
| 3,725,818 | 4/1973 | Nurmohamed et al. | 330/124 D |
| 3,955,187 | 5/1976 | Bigelow | 345/58 |
| 4,390,874 | 6/1983 | Woodside et al. | 345/101 |
| 4,824,218 | 4/1989 | Kuro et al. | 345/97 |
| 4,827,221 | 5/1989 | Botti et al. | 330/51 |
| 4,873,516 | 10/1989 | Castleberry | 345/58 |
| 5,010,326 | 4/1991 | Yamazaki et al. | 345/94 |
| 5,033,822 | 7/1991 | Ooki et al. | 345/101 |
| 5,070,326 | 12/1991 | Yoshimoto et al. | 345/91 |
| 5,088,806 | 2/1992 | McCartney et al. | 345/101 |
| 5,130,703 | 7/1992 | Fairbanks et al. | 345/94 |
| 5,151,690 | 9/1992 | Yamazaki . | |
| 5,179,371 | 1/1993 | Yamazaki . | |
| 5,307,084 | 4/1994 | Yamaguchi et al. | 345/58 |
| 5,438,342 | 8/1995 | Yanaguchi | 345/58 |

FOREIGN PATENT DOCUMENTS

| | | |
|---|---|---|
| 262 714 A1 | 4/1988 | European Pat. Off. . |
| 0 374 845 A2 | 12/1989 | European Pat. Off. . |
| 438 093 A3 | 7/1991 | European Pat. Off. . |
| 466 506 A3 | 1/1992 | European Pat. Off. . |

OTHER PUBLICATIONS

"Cross–Modulation and Disuniformity Reduction in the Addressing of Passive Matrix Displays" By Paolo Maltese pp. 15–20 Sep. 18–20, 1984.

*Primary Examiner*—Richard Hjerpe
*Assistant Examiner*—Lun-Yi Lao
*Attorney, Agent, or Firm*—Limbach & Limbach L.L.P.

[57] ABSTRACT

A method and apparatus for compensating crosstalk in liquid crystal displays is disclosed which involves applying boost voltages to the rows and columns of the display in proportion to the number of ON pixels in a row or column, the number of transition between "ON-and-OFF" or "OFF-and-ON" in each column, and the position of the pixel in a row. "Boost" voltages are applied to each row as it is being actively scanned to provide horizontal crosstalk compensation, while "boost" voltages are applied to each column during the vertical retrace interval of the display sequence to provide vertical crosstalk compensation. In a preferred embodiment, the vertical crosstalk compensation is determined during the vertical retrace interval over several flames.

60 Claims, 19 Drawing Sheets

KEY TO FIG. 1

14
ROW DRIVERS
18
ROW DRIVERS
MOD
LFS
LINE CLK (CP1)
V0
V1
V4
V5
22
DATA
SHIFT CLK (CP2)
LINE CLK (CP1)
MOD
LFS
DISPLAY CONTROLLER
20
CPU
24
V0
V1
V2
V3
V4
V5
VOLTAGE GEN.

| APPLIED VOLTAGES MOD = 0 | | | COLUMN DATA ON −17V [V5] | COLUMN DATA OFF −15V [V3] |
|---|---|---|---|---|
| ROW | ACTIVE | 0V [V0] | − 17V + | − 15V + |
| ROW | NON-ACTIVE | −16V [V4] | − 1V + | + 1V − |

| APPLIED VOLTAGES MOD = 1 | | | COLUMN DATA ON 0V [V0] | COLUMN DATA OFF −2V [V2] |
|---|---|---|---|---|
| ROW | ACTIVE | −17V [V5] | + 17V − | + 15V − |
| ROW | NON-ACTIVE | −1V [V1] | + 1V − | − 1V + |

FRAME 1 (MOD=0)
FRAME 2 (MOD=1)
0 1 2 3 4 0 1 2 3 4
ROW. NO.
VOLTS
0 -1 -2 -15 -16 -17
$V_{NC0,0}$
$V_{NR0,0}$ $P_{0,0}$
DIFFERENCE VOLTS
+15 +14 +1 0 -1 -15 -16 -17
$V_{P0,0}$

FRAME 1 (MOD=0)
FRAME 2 (MOD=1)
ROW. NO.
VOLTS
0 -1 -2 -15 -16 -17
$V_{NC1,0}$
$V_{NR1,0}$ $P_{1,0}$
DIFFERENCE VOLTS
+17 +16 +1 0 -1 -16 -17
$V_{P1,0}$

FRAME 1 (MOD=0)
FRAME 2 (MOD=1)
ROW. NO.
VOLTS
0
-1
-2
-15
-16
-17
$V_{NC2,0}$
$V_{NR2,0}$ $P_{2,0}$
DIFFERENCE VOLTS
+15
+14
+1
0
-1
-15
-16
-17
$V_{P2,0}$

KEY TO FIG. 8
ROW DRIVERS
14
ROW DRIVERS
18
MOD
FLM (LFS)
LINE CLK (CP1)
V0'''
V1
V4
V5'''
V0''
V5''
V0'
V5'
V0 V5
V0+ V0 V5- V5
V0', V5' UPPER SEG. COL. DRVR.
46
V0', V5 UPPER SEG. ROW DRVR.
47
MUX
S
49
51
42
44
D/A
48
50
22
DATA
SHIFT CLK (CP2)
LINE CLK (CP1)
MOD
LFS
XTU
HU
HXU
DISPLAY CONTROLLER
XTL HL HXL
20'
CPU
3
K1, K2, K3
53
VMEM
110
V5- V5 V4 V3 V2 V1 V0- V0+
VOLTAGE GEN.
24'

METHOD AND APPARATUS FOR COMPENSATING CROSSTALK IN LIQUID CRYSTAL DISPLAYS

This is a continuation of application Ser. No. 08/342,783 filed on Nov. 21, 1994, now abandoned which is a continuation of application Ser. No. 08/043,001 filed on Apr. 5, 1993, now abandoned.

TECHNICAL FIELD

The present invention is directed to liquid crystal displays ("LCDs"), and more particularly to a method and apparatus for removing crosstalk from passive matrix LCDs.

BACKGROUND ART

Crosstalk, also known as "ghosting", "shadowing" or "streaking", in LCDs manifests itself as a dark or light area in the display at the end of a column or row of display elements or pixels. In the absence of crosstalk, these areas would have the normal background shade or color.

It is believed that crosstalk is caused by the reduction or increase in the magnitude of the excitation voltages being applied to the pixels in the rows and columns due to loading effects caused by pixel capacitance on the column and row drivers and the voltage drops due to series-resistance in the row and column electrodes of the LCD. Thus, the number of pixels which are "ON" in a row or column, and the number of transitions between "ON" and "OFF" states in a column, and the location of a column, will affect the severity of the crosstalk.

A number of solutions have been proposed to remove crosstalk in LCDs. In European Patent Application 0 374 845, entitled "Method and Apparatus for Driving a Liquid Crystal Display Panel," published Jun. 27, 1990, the crosstalk phenomena is described in detail, and several crosstalk compensation techniques are disclosed. In this reference crosstalk is viewed as producing undesirable spike pulses on the scan electrodes; i.e. in the rows. One approach disclosed is to apply to the data driver or scan driver a spike pulse which has an amplitude and shape which compensates for the undesirable spike pulses induced on the scan electrodes. Another described technique is to apply a direct current compensating voltage to the scan drivers during the period of selecting a scan electrode which is the effective equivalent of the undesirable spike voltage.

In U.S. Pat. No. 5,010,326, to Yamazaki et al., issued Apr. 23, 1991, crosstalk compensation is provided by applying a compensating waveform to a specific row or to all rows (so that all columns are affected) of the LCD.

A disadvantage of these prior approaches is that essentially no attention is paid to individual columns of a display and as a result no compensation measures are taken to correct columns on an individual basis.

A desirable solution would provide very good removal of crosstalk at little additional power, and with low additional cost.

It is therefore highly desirable to provide a crosstalk compensation method and apparatus which provides good removal of crosstalk, with few side affects, at low cost, low power consumption, low impact on increase in display controller pinout requirements into which it is incorporated, low interface impact with other parts of the LCD display system, few changes to LCD panel, compatible with single scan or dual scan LCDs, compatible with monochrome or color LCDs, has the potential to be used with techniques which address multiple rows at one time, such as Active Addressing or Multiple Line Scan techniques and Active Matrix displays, and provides flexible implementation alternatives to lower hardware impact.

SUMMARY OF THE INVENTION

The above and other problems and disadvantages of prior crosstalk compensation techniques are overcome by the method and apparatus of the present invention which involves applying boost voltages to the rows and columns of the display in proportion to the number of "on" pixels in a row or column, the number of transition between "on-and-off" or "off-and on" in each column, and the position of the column relative to the row driving source. "Boost" voltages are applied to each row as the row is being actively scanned, to provide horizontal crosstalk compensation, while "boost" voltages are applied to each column during the vertical retrace interval of the display sequence to provide vertical crosstalk compensation. Vertical compensation errors due to loading effects on the row drivers can be counteracted during the vertical retrace interval by an appropriate additional "boosting" of voltages supplied to the column drivers, or alternatively to the row drivers. In a preferred embodiment, the vertical crosstalk compensation is determined during the vertical retrace interval over several frames.

In the preferred implementation of the present invention, the vertical crosstalk compensation signal is determined by a display controller during the vertical retrace interval, and utilizes off-chip video memory to store pixel state information and transition data.

A unique boost voltage generating circuit is provided which employs operational amplifiers connected as non-inverting amplifiers, but with selected resistors in their feedback paths, and a resistance element connected between the inverting inputs of the operational amplifiers, so that a common current is permitted to flow through the feedback resistors.

The present invention provides an inexpensive, yet effective, modification of conventional display controller chips with a minimum of hardware additions and changes.

These and other features of the present invention will be more readily understood upon consideration of the following detailed description of the invention and the accompanying drawings.

DETAILED DESCRIPTION OF THE INVENTION

Figures 1A, 1B:
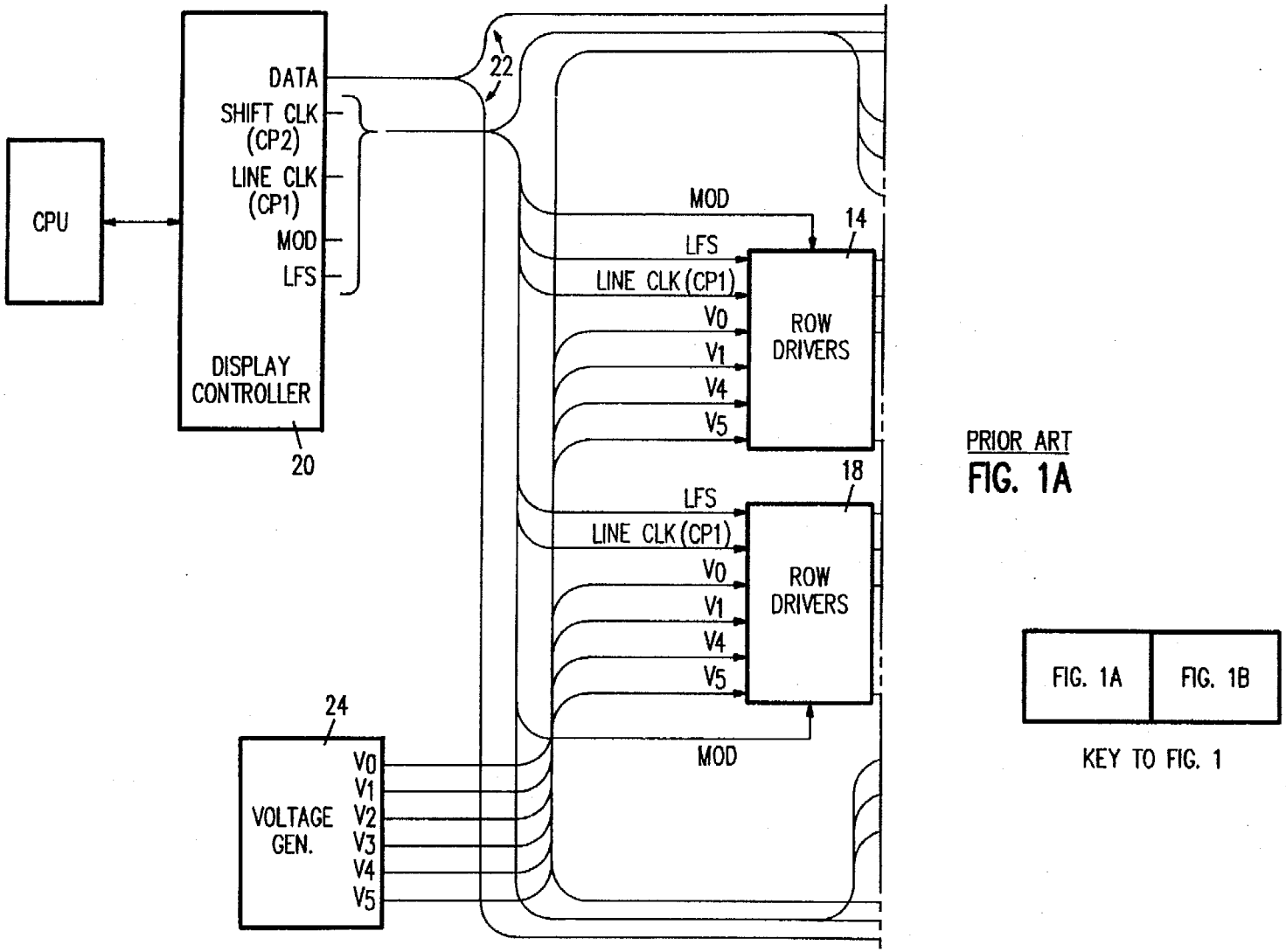
PRIOR ART FIG. 1A
FIGS. 1A and 1B illustrate a conventional dual-segment LCD controller/driver arrangement.

Referring to FIGS. 1A and 1B, a conventional dual-segment LCD controller/driver arrangement is shown. Although the present explanation is in the context of a dual-segment LCD, it is to be understood that the present invention is equally applicable to LCDs with single or other numbers of multiple segments.

In the dual-segment LCD example of FIGS. 1A and 1B, an LCD segment 1 and an LCD segment 2 are each driven by a set of column and row drivers. More particularly, LCD segment 1 has 640 columns and 240 rows, with LCD segment 2 having a like number. In the example, each of the column drivers 12 drive eighty (80) different columns of the LCD segment 1, so that there are a total of eight (8) such drivers for LCD segment 1. Row driver 14 is shown providing a drive signal to each of the 240 rows of LCD segment 1. It is to be understood that in practice the row driver 14 may take the form of several separate driver chips each handling an assigned number of rows.

In a similar fashion, the 640 columns of LCD segment 2 are driven by eight (8) column drivers 14, each handling eighty (80) columns apiece; and row drivers 18 drive the 240 rows. It is to be understood that other driver chips handle more or fewer numbers of rows or columns, and that the quantities being used in this description are merely for purposes of illustration by way of example.

The column drivers 12 and 16 each receive data from display controller 20 via data bus 22. Also received are: a first line marker ("FLM", also known as an LCD frame start, "LFS") signal which indicates the start of a new frame of data; a line clock ("LINE CLK CP1") which indicates the start of a new line of data; a shift clock ("SHIFT CLK CP2"), which indicates the timing from pixel to pixel; and a MOD signal which controls the modulation of the pixel excitation voltages so that the liquid crystal material is operated under alternating current conditions, and so that direct current levels are minimized.

Pixel excitation voltages are supplied to each of the column drivers 12 and 16, and row drivers 14 and 18, from voltage generator block 24. An example of these voltages is provided in Table 1:

TABLE 1

$V_5$=−17 V
$V_4$=−16 V
$V_3$=−15 V
$V_2$=−2 V
$V_1$=−1 V
$V_0$=−0 V

The voltages in Table 1 are merely an example, and other voltage ranges and relative magnitudes are possible.

Figure 2A:
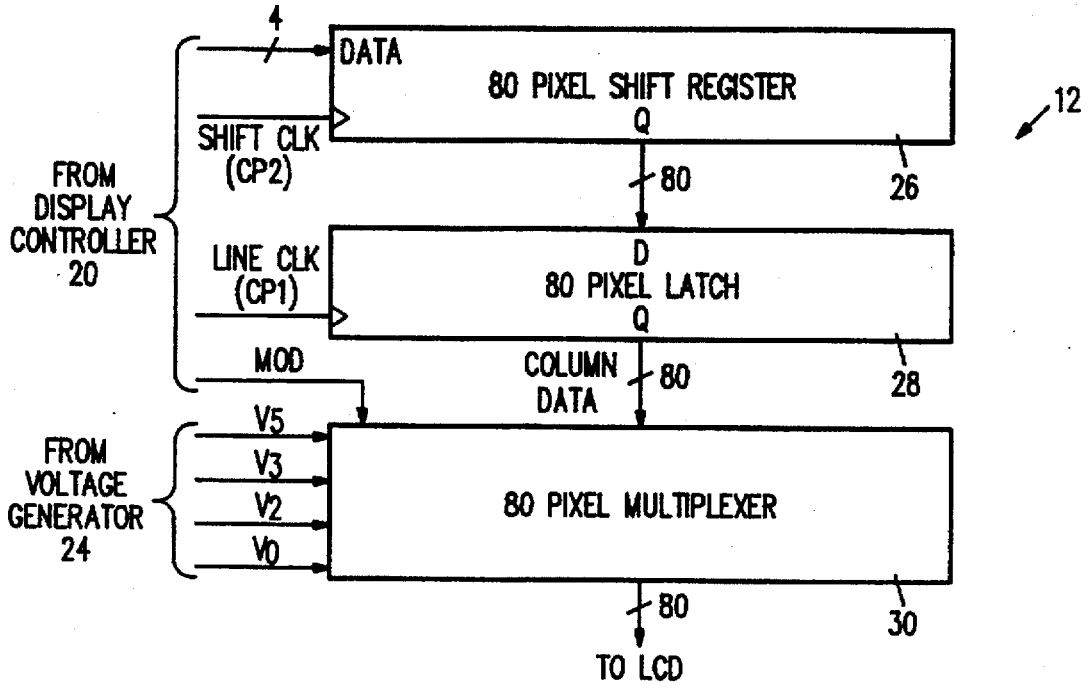
PRIOR ART FIG. 2A
FIG. 2A is a simplified functional block diagram of an typical column driver.
Figure 2B:
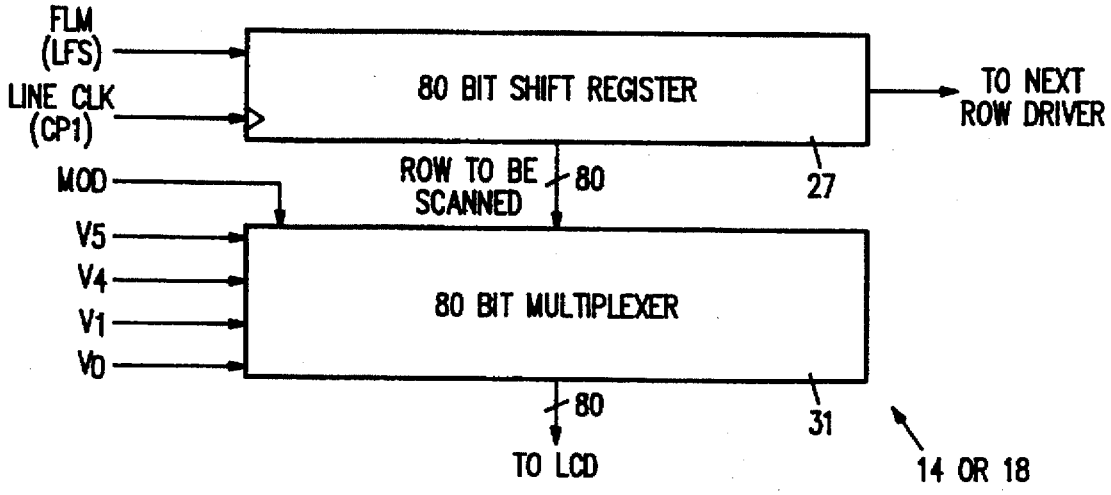
PRIOR ART FIG. 2B
FIG. 2B is a simplified functional block diagram of an typical row driver.
Figures 3, 4, 5:
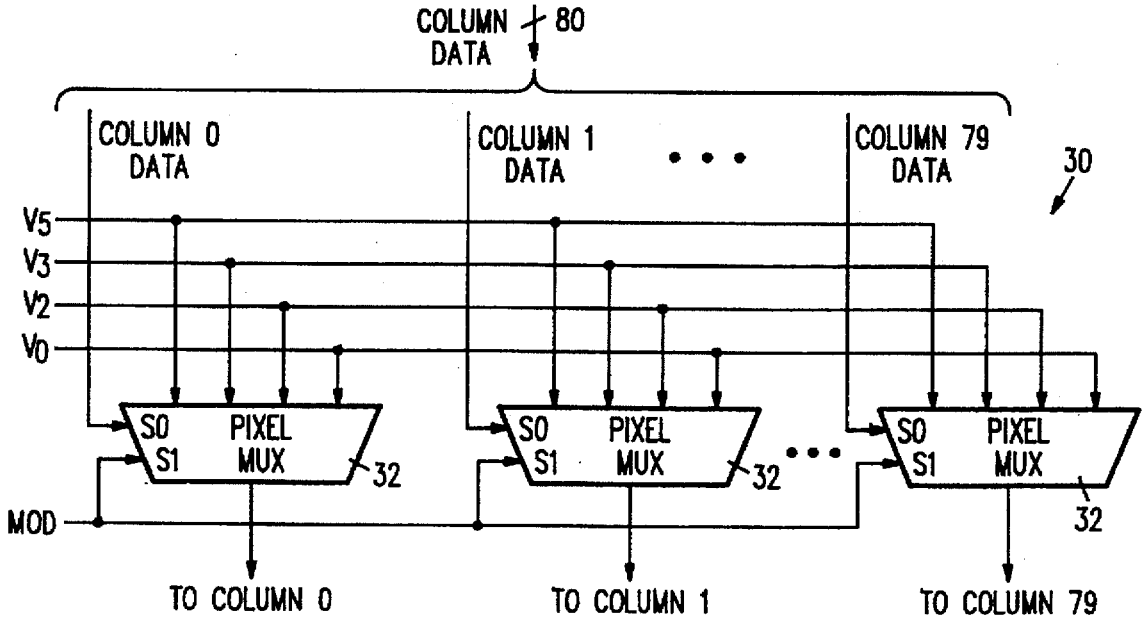
PRIOR ART FIG. 3
PRIOR ART FIG. 4
PRIOR ART FIG. 5
FIG. 3 is a more detailed functional block diagram of the 80 pixel multiplexer of FIG. 2A.
FIG. 4 is an illustrative example of the voltages selected for output by the column driver (multiplexer 32) when the MOD signal is a logic zero.
FIG. 5 shows the selected voltage for output by the column driver when the MOD signal is a logic one.

Referring now to FIGS. 2A, 2B, and 3, the manner in which these voltages are selected and applied to the rows and columns of the LCD will now be described. FIG. 2A is a functional block diagram of a typical column driver 12 or 16.

First, display data is received in four-bit nibbles at the data input of 80-pixel shift register 26. The data is shifted in according to shift clock (CP2). After eighty display data bits have been shifted into shift register 26 they are provided as an 80 bit parallel output to 80 pixel latch 28, and latched therein when the line clock signal is asserted. These 80 bits of display data are then applied to 80-pixel multiplexer 30. The 80 pixel multiplexer 30 also receives four voltage inputs, $V_5$, $V_3$, $V_2$, and $V_0$ from voltage generator 24, and the MOD signal from display controller 20.

The 80-pixel multiplexer 30 is shown in more detail in FIG. 3, where it can be seen that a multiplexer 32 is provided for each pixel data bit, and is associated with a particular column. Furthermore, it can be seen that the pixel data bit and the MOD signal serve as selection signals to the multiplexer 32, that the four voltages, $V_2$, and $V_0$, are applied as inputs to multiplexer 32, and that one of the four voltages is selected as an output in accordance with the logic states of the pixel data bit and the MOD signal.

The relationship between the pixel data bit, the MOD signal state, and the resulting selected voltages, are illustrated in FIGS. 4 and 5, and in Table 2. FIG. 4 shows the voltages selected for output by the column driver (multiplexer 32) when the MOD signal is a logic zero, while FIG. 5 shows the selected voltage for MOD in a logic one state. Thus, for example, if the pixel data bit is a logic one ("ON"), and the MOD signal is also a logic zero, the output of multiplexer 32 will be $V_5$, or −17 V. See FIG. 4.

Conversely, if MOD is a logic one, and the pixel data bit is a logic zero ("OFF"), the multiplexer output will be $V_2$, or −2 V. See FIG. 5.

TABLE 2

| S1 | S2 | COLUMN | ROW DRIVER OUT | |
|---|---|---|---|---|
| [MOD] | [DATA] | DRIVER OUT | ACTIVE | NON ACTIVE |
| 0 | 0 | $V_3$ [−15 V] | $V_0$ [0 V] | $V_4$ [−16 V] |
| 0 | 1 | $V_5$ [−17 V] | $V_0$ [0 V] | $V_4$ [−16 V] |
| 1 | 0 | $V_2$ [−2 V] | $V_5$ [−17 V] | $V_1$ [−1 V] |
| 1 | 1 | $V_0$ [0 V] | $V_5$ [−17 V] | $V_1$ [−1 V] |

Also shown in FIGS. 4 and 5 are the output voltages of the row driver as a function of the MOD signal and whether the particular row is "ACTIVE", i.e. being scanned, or "NON-ACTIVE", i.e. not being scanned. For example, then MOD is a logic zero, and the particular row is ACTIVE, a voltage $V_0$ will be output to the row by the particular row driver.

FIGS. 4 and 5 therefore provide an example of the potentials being applied to a particular pixel as a function of the MOD signal, of whether the row in which it is located is currently being scanned, and of the logic state of the pixel data bit. Thus, for example, for a MOD signal of logic state one, a logic one pixel data bit, and a NON-ACTIVE row, the pixel will receive one volt across it; namely 0 V from the column driver, and −1 V from the row driver. For MOD of logic state zero, −1 V will be applied across the pixel.

Figure 1B:
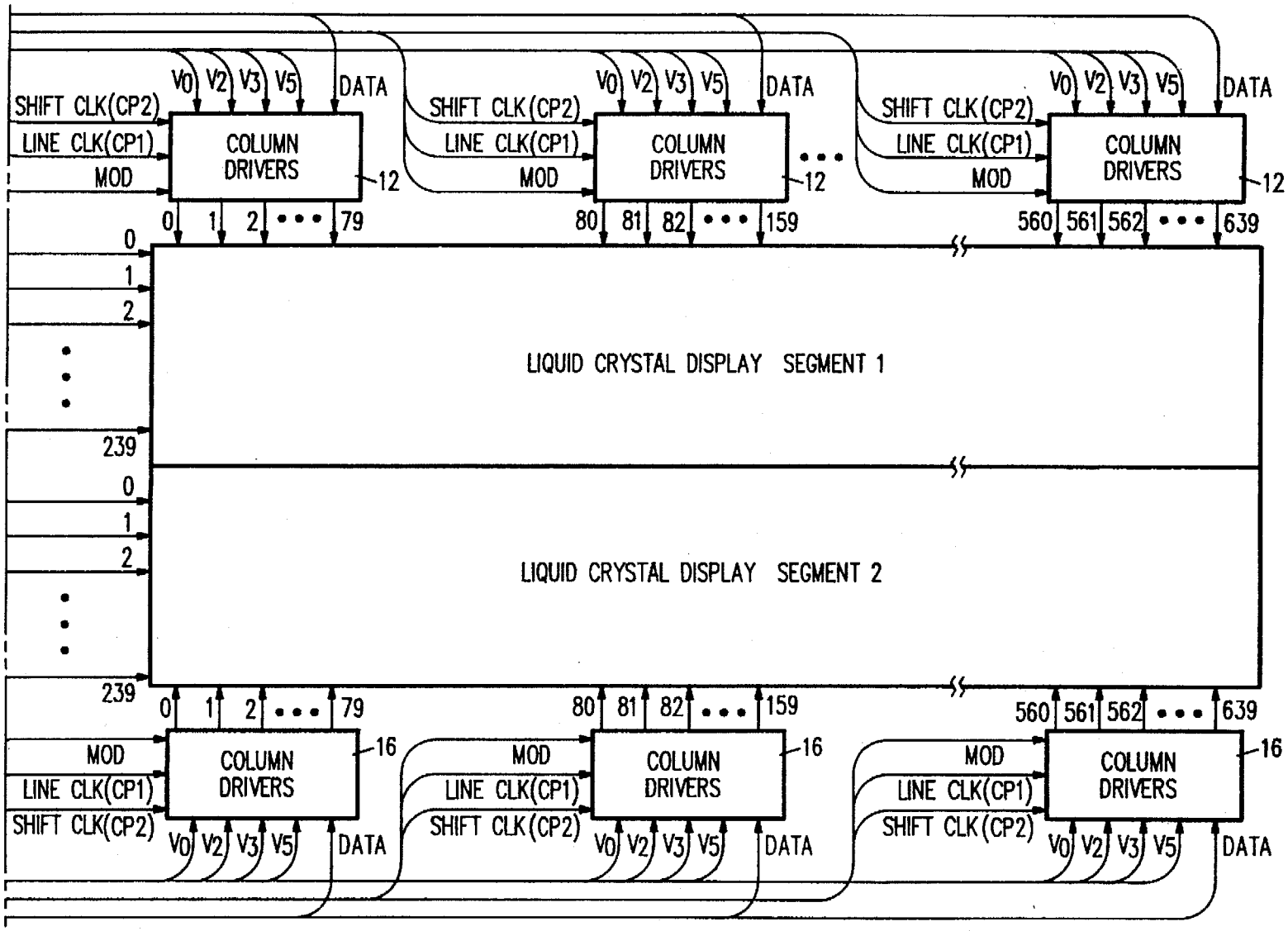
PRIOR ART FIG. 1B

It is to be understood that the typical row driver 14 or 18 in FIG. 1 will have a multiplexer structure 31 similar to that of multiplexer 30, except that the drive voltages provided to it will be $V_0$, $V_1$, $V_4$, and $V_5$, and the "data" will be supplied by an 80-bit shift register 27 which is shifting the first line marker ("FLM") using the LINE CLK (CP1) as a dock. The particular output pin of shift register 27 at which the FLM bit is present indicates the row currently being scanned. Where 80 bit output row driver chips are used in a 240 row LCD segment, three such row driver chips will be used. The FLM bit is shifted through the first row driver chip, then into the second, and finally into the third. In this manner, the 240 rows of the LCD are scanned consecutively.

Figure 6:
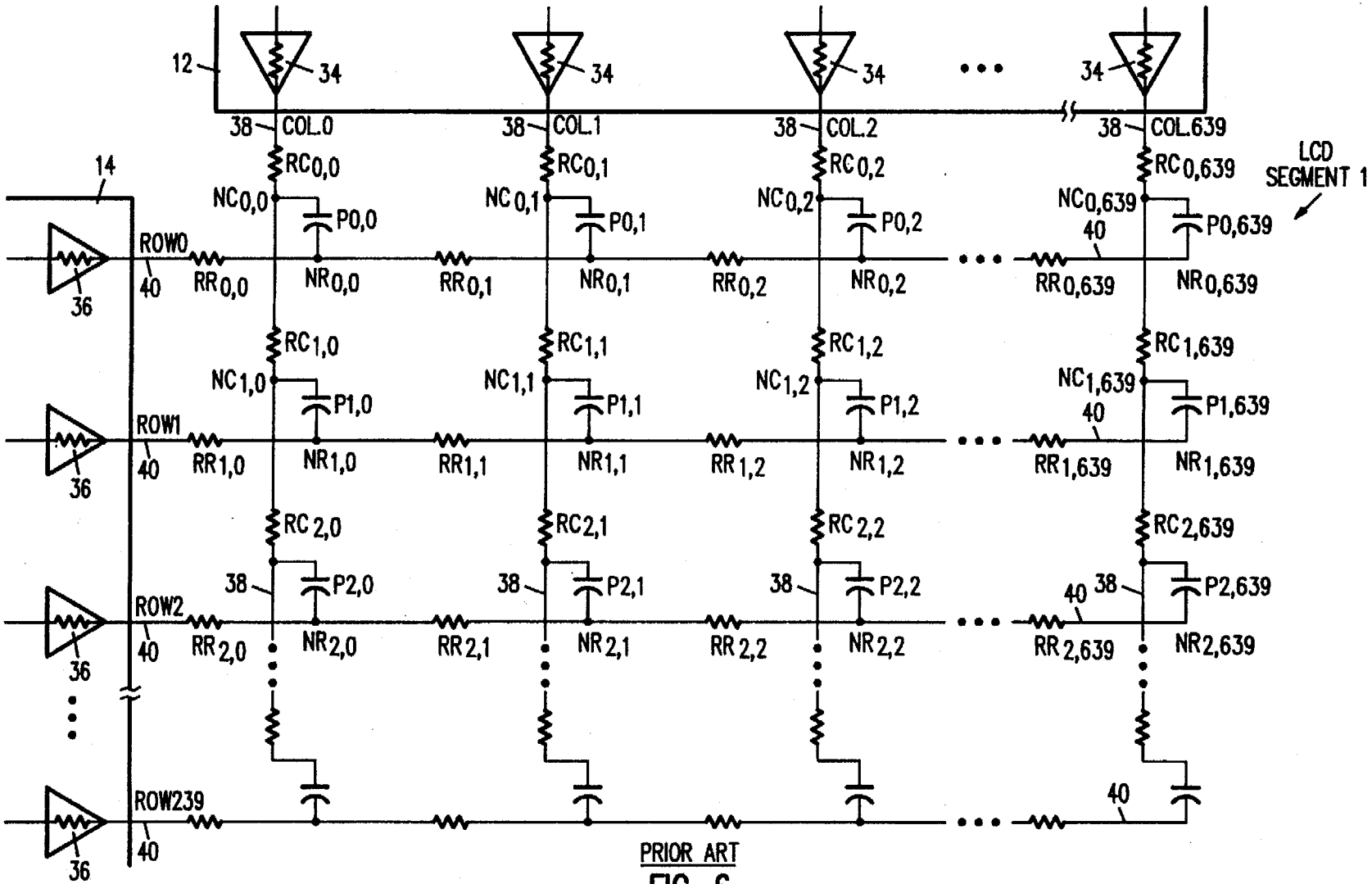
PRIOR ART FIG. 6
FIG. 6 is an approximate equivalent circuit illustration of LCD segment 1 of FIGS. 1A and 1B, and the output circuits of column drivers 12 and row drivers 14.

FIG. 6 is an approximate equivalent circuit illustration of LCD segment 1 and the output circuits of column drivers 12 and row drivers 14. Each of the column drivers is indicated to have a resistance 34 in series with its output, while each of the row drivers has a resistance 36 in series with its output.

Pixels are modelled as capacitors and labelled with pixel designations $P_{x,y}$, for example $P_{0,0}$ or $P_{2,639}$, where the first subscript represents the row number, and the second presents the column number, of the particular pixel. In the remainder of this description, the notation $P_{x,y}$ will be used as referring to pixels, it being understood that capacitors shown in FIG. 6 and bearing such labels, are representative of the pixels of the LCD. The location of a particular pixel is determined by the intersection of the column electrode 38 and row electrode 40 for the particular pixel. Typically, the column and row electrodes are constructed of a transparent conductive material such as indium tin oxide ("ITO") which has a given conductivity. The materials used in older LCD panels have conductivities on the order of 30 Ω/□, while newer panels are more like 5 to 10 Ω/□.

The impact of these conductivities on signals conducted along the row and column electrodes are represented by lumped resistors $RC_{x,y}$, in series with the column electrodes 38, and lumped resistors $RR_{x,y}$, in series with the row electrodes 40. As before, superscript notation x represents the row, and the notation y represents the column, for the particular lumped resistor. Thus, resistor $RC_{2,2}$ represents the distributed resistance in the column electrode 38 between pixel $P_{1,2}$ and $P_{2,2}$, while resistor $RR_{1,0}$ represents the distributed resistance in the row electrode 40 between the row 1 driver and pixel $P_{1,0}$.

Finally, the notation $NC_{x,y}$ and $NR_{x,y}$ is used to refer to a column node, or row node, respectively, at the location of the pixel $P_{x,y}$. Thus, for example, pixel $P_{1,1}$ has associated with it, node $NC_{1,1}$ representing the point in the column electrode 38 which provides the column voltage for exciting the pixel, and with node $NR_{1,1}$ representing the point in the row electrode 40 which provides the row voltage to the particular pixel.

As can be appreciated from FIG. 6, whenever there is a change in the voltages applied by the row and column electrodes to a pixel, there will be some level of current flow along the row and column electrodes. The magnitude and duration of the current flow will be a function of the magnitude of the voltage change, and the magnitude of the capacitance of the pixel and the resistances of the row/column electrodes, and their driver output resistances.

Such current flow will cause voltage losses along the row and column electrodes due to the "I×R" drop across the $RC_{x,y}$ and $RR_{x,y}$ resistances. Furthermore, there will be an additional reduction in the voltage levels applied to the row and column electrodes because of the series resistances 36 and 34 of the row and column drivers, respectively.

Thus, it should be appreciated that in any one column, the more transitions there are from one pixel state to another, and the more "ON" pixels there are, the more significant the voltage losses along the column electrode. A similar situation is present in the row electrode.

Thus, within each row or column of pixels, under these conditions, there will be a significant drop in the voltages applied to the pixels. Hence, the monochrome or color level in these regions will be different, lighter or darker, than the levels for other regions of the display which are supposedly at the same display state.

FIGS. 7A through 7F illustrate the waveforms of the voltages applied to pixel $P_{0,0}$ (FIGS. 7A and 7B), $P_{1,0}$ (FIGS. 7C and 7D), and $P_{2,0}$ (FIGS. 7E and 7F), over two frames, for the pixel states shown in Table 3, and as a function of the row being scanned:

TABLE 3

| | COLUMN | | |
|---|---|---|---|
| | 0 | 1 | 2 . . . |
| ROW | | | |
| 0 | OFF | ON | . . . |
| 1 | ON | ON | . . . |
| 2 | OFF | OFF | . . . |
| 3 | OFF | OFF | . . . |
| 4 | OFF | ON | . . . |

Figures 7A, 7B, 7C, 7D:
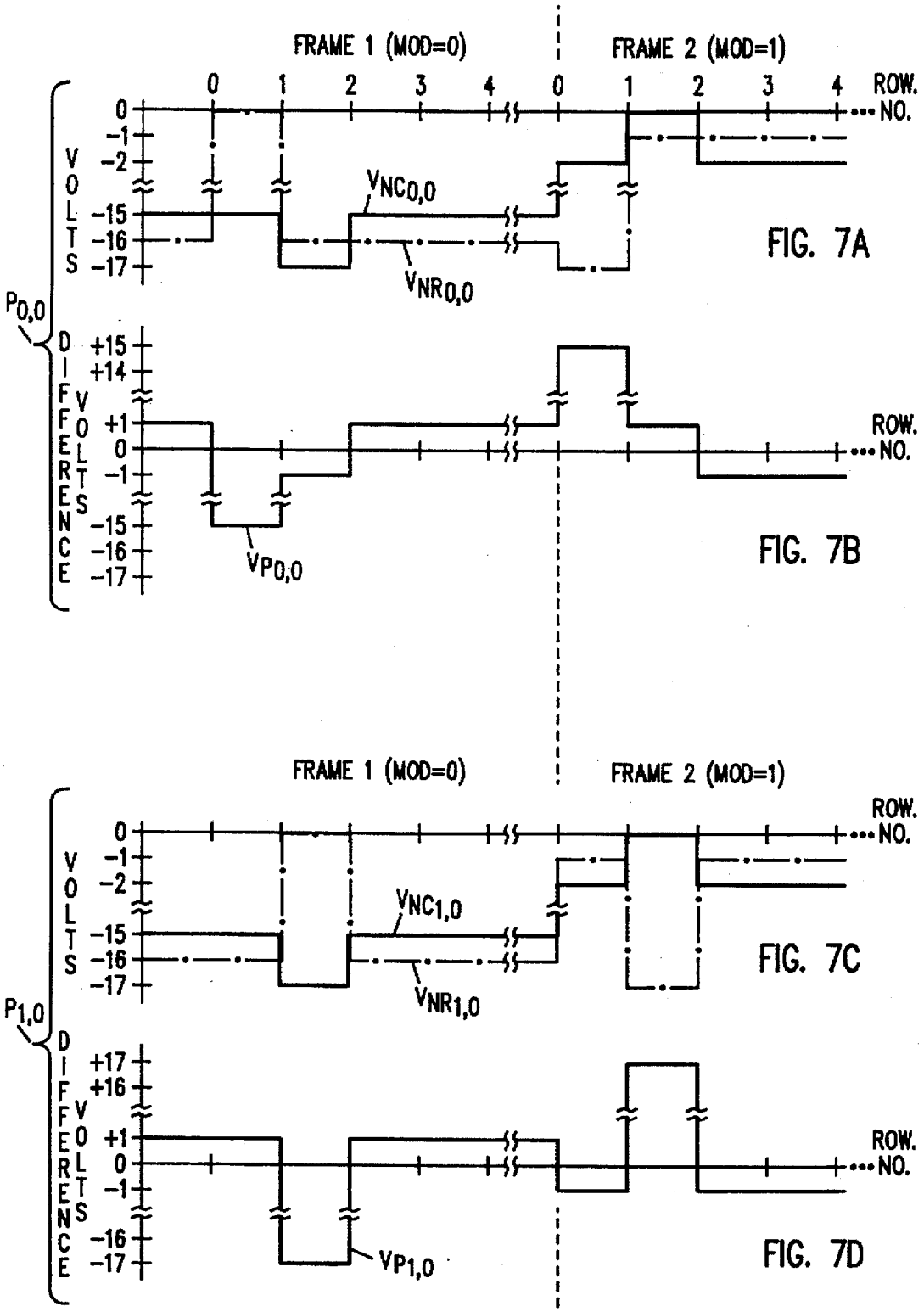
FIGS. 7A through 7F illustrate the waveforms of the voltages applied to pixels $P_{0,0}$, $P_{1,0}$, and $P_{2,0}$ as a function of the row being scanned.
Figures 7E, 7F:
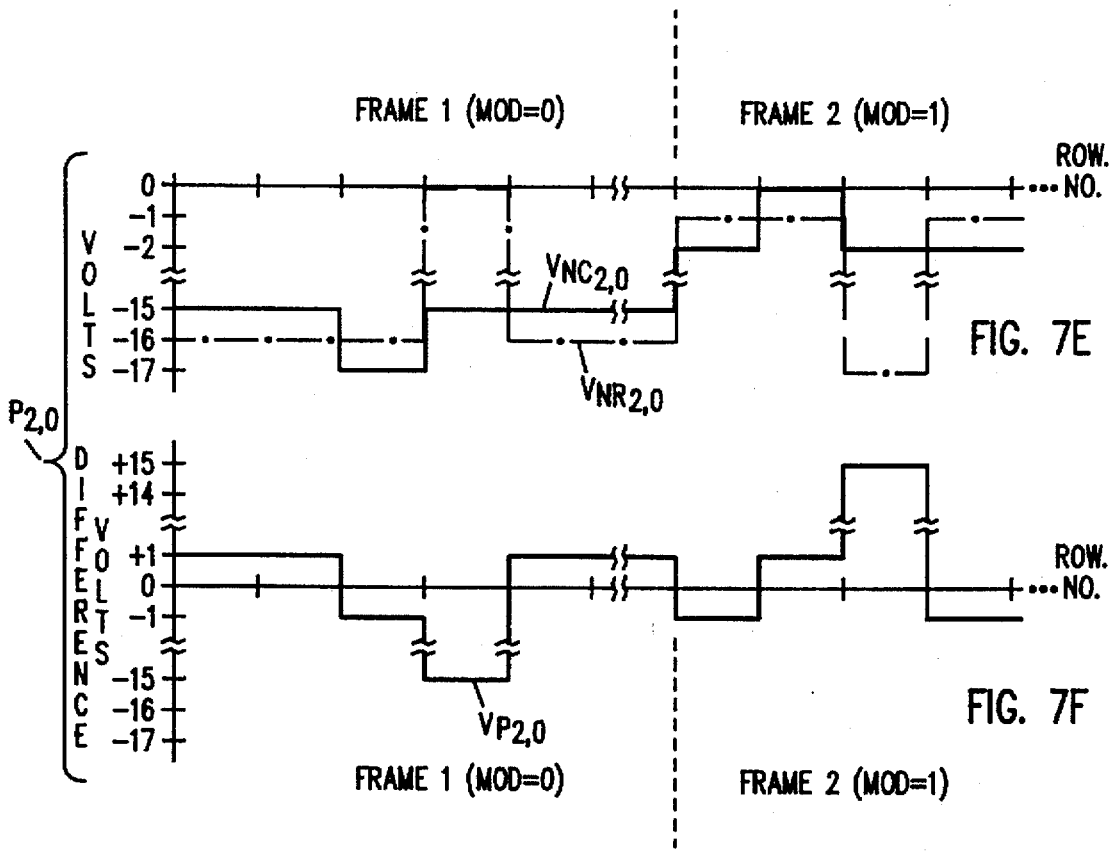

In each of FIGS. 7A, 7C, and 7E, the voltage present at column node $NC_{0,0}$ is shown as a solid line waveform, while the voltage present at row node $NR_{0,0}$ is shown as a dot-dash line waveform. The horizontal axis corresponds to the row which is active when the voltage level shown is present at the node for the pixel, while the vertical axis corresponds to voltage.

In FIGS. 7B, 7D, and 7F, the voltage difference across the pixel is shown as a function of the active row. For example, FIG. 7C shows that in frame 1, when row 1 is active, the voltage at $NR_{1,0}$ is 0 V and the voltage at $NC_{1,0}$ is −17 V. FIG. 7D shows that the voltage being applied across pixel $P_{1,0}$ when row 1 is active, is −17 V. Thus, from FIGS. 7B, 7D, and 7F, the magnitude of the voltage changes across a pixel is illustrated.

As is well known, a change in voltage across a capacitance will cause an apparent momentary flow of current through the capacitance. Thus, it should be appreciated that each change in the voltage applied to a pixel causes a momentary current flow that results in a loss in the drive voltage (a rounding of the drive waveform) to the non-pixels (those not being activated), which in turn results in a dimming of those pixels. It is also possible to "add" a spike which could increase the brightness as well, however, the techniques described herein tend to deal with the rounding of the drive waveform which tends to dim pixels. It is therefore to be understood that the methodology of the present invention can be also employed within the scope of the invention in connection with crosstalk compensation which would correct the problems associated with a spike as well.

Crosstalk Compensation:

In accordance with the present invention, a vertical crosstalk compensating signal is generated and applied to each column of the LCD during the vertical retrace portion of the display cycle. A horizontal crosstalk compensation signal is generated prior to and applied during the scanning of each row. The vertical crosstalk compensating signal is a function of the number of pixels which are ON in a column, the number of transitions between ON and OFF in each column, and the column position in the row, while the horizontal crosstalk compensation signal is a function of the number of ON pixels in the row.

In accordance with the present invention, the vertical retrace interval is divided up into retrace scan-lines. For example, where the vertical retrace period is set to be compatible with a CRT format (523 scan lines), there will be 43 retrace scan-line intervals in the retrace period (523 less 480 LCD rows). It is during these 43 retrace scan-lines that the vertical crosstalk compensation is determined and applied to each of the columns. Where it is not important to scan in synch with a CRT, a longer vertical retrace period can be used, but at the cost of a lower contrast ratio, which is due to the increased duty cycle.

In one embodiment of the present invention, the compensating signal has a predetermined DC level and is applied over a selected number of retrace scan-lines, with the predetermined DC level having a different duration in each of the retrace scan-lines. Thus, in the first retrace scan-line the predetermined DC level might be present for 512 out of 640 possible pixel docks, while in the eighth retrace scan-line the predetermined DC level is present for only 4 out of the 640 pixel docks.

Alternatively, combinations of several different voltage levels and numbers of retrace scan-line times are employed to provide several different effective compensating levels. In this alternative embodiment, a voltage level is present over an entire retrace scan-line, but one retrace scan-line might present $V_{boost1}$, while a different retrace scan-line might present $V_{boost\ 1/2}$, for example.

In accordance with the present invention it is envisioned that horizontal crosstalk compensation is obtained in accordance with the conventional approach: applying a DC voltage to each row which is a function of the number of "ON" pixels in the row while the row is active, i.e. being scanned.

The implementation of the crosstalk compensation technique of the present invention will now be explained in greater detail in the context of a display controller which has been modified to include such compensation, it being understood that it is not a requirement for the successful use of the present invention that it be implemented in such a controller.

Figures 8A, 8B:
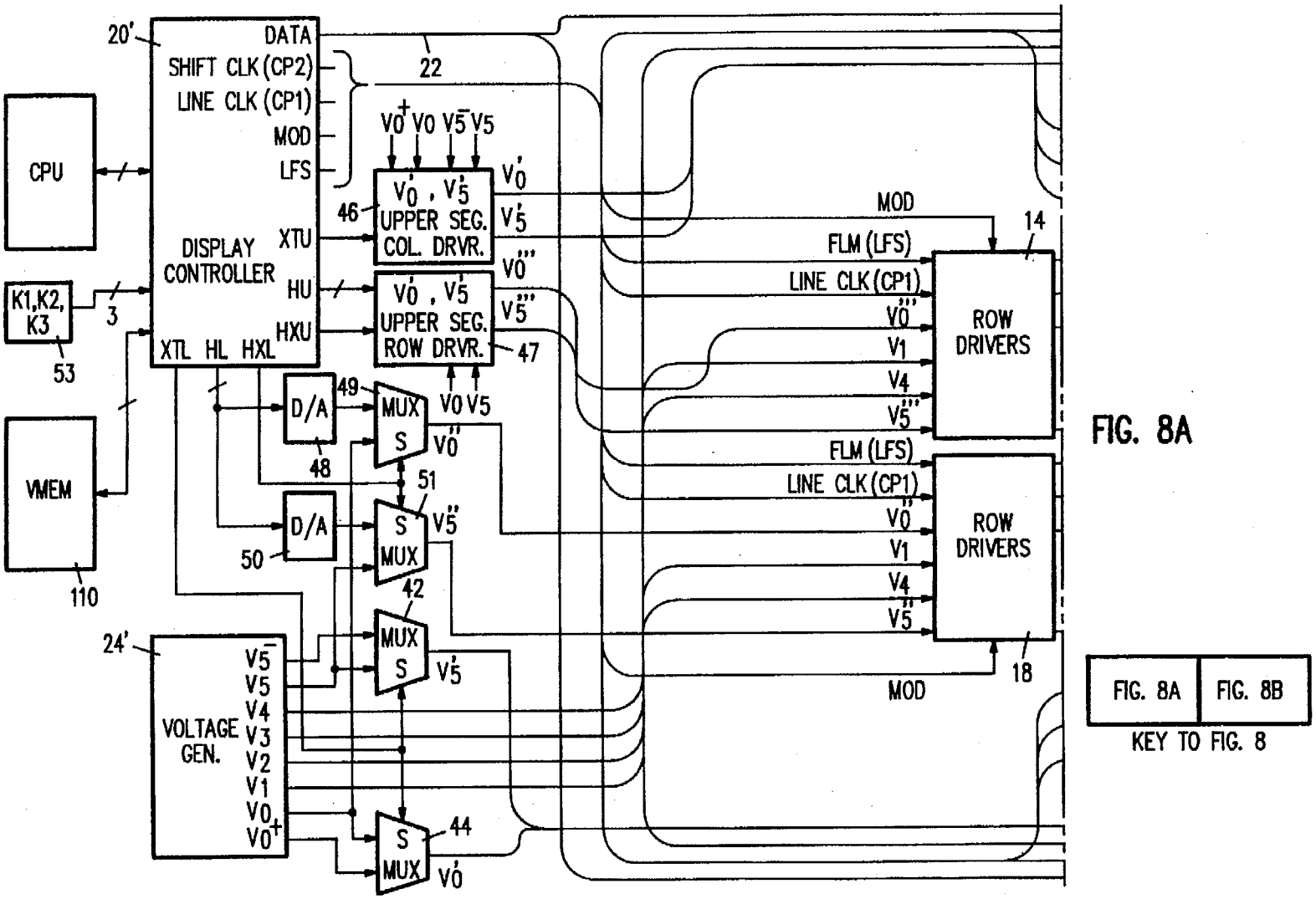
FIGS. 8A and 8B are simplified functional block diagrams of a modified version of FIGS. 1A and 1B which illustrate an implementation of the present invention in a conventional LCD display configuration.
Figure 8B:
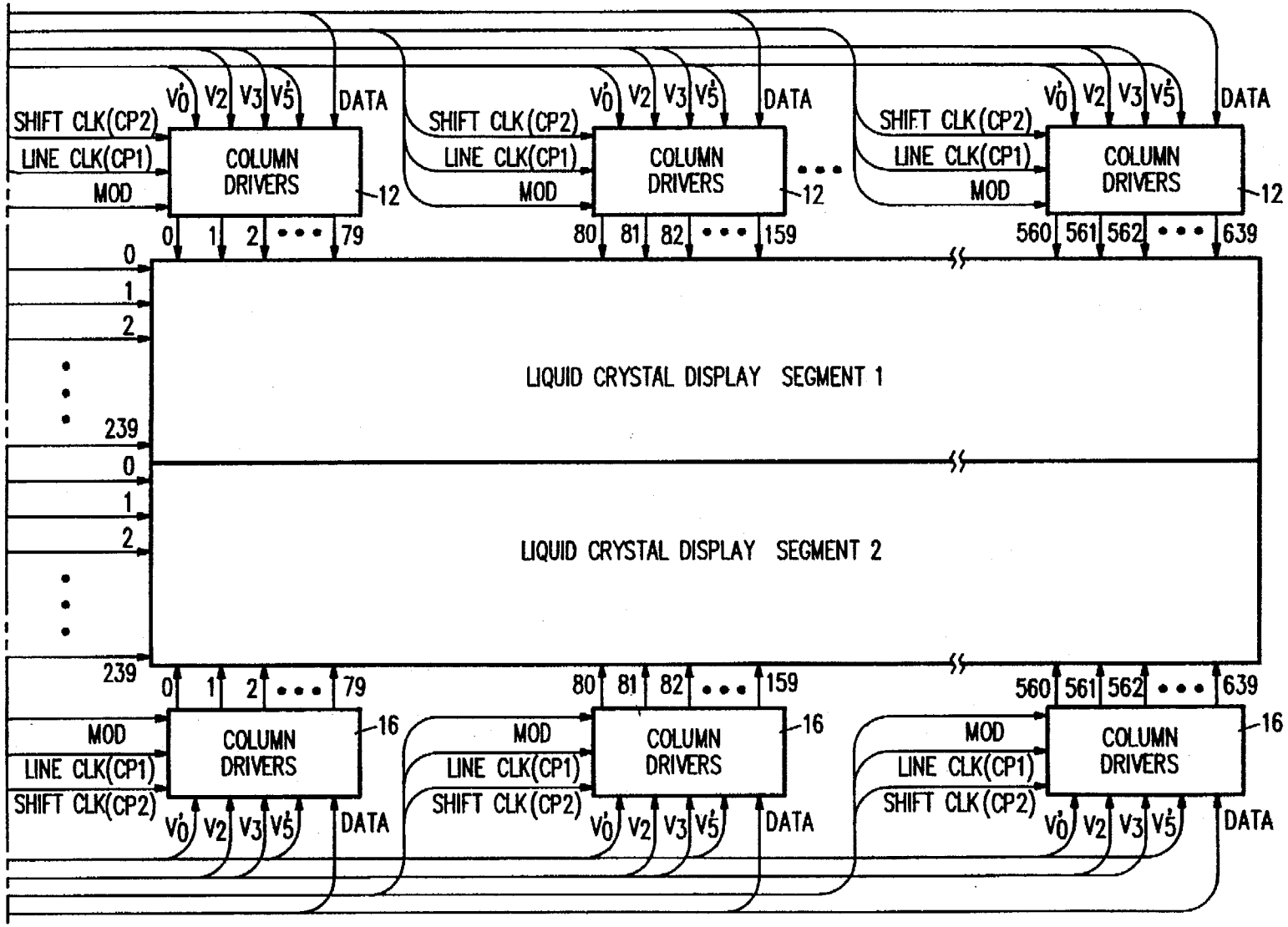

Referring to FIGS. 8A and 8B, the conventional LCD display configuration of FIG. 1 has been modified in accordance with the present invention.

It is to be noted that voltage generator 24' now provides two additional voltages, $V_5^-$ and $V_0^+$, which can be viewed as "boost" voltages. For vertical crosstalk compensation of LCD Segment 2, these voltages are provided to the column drivers 16 through multiplexers 42 and 44 using the same lines as provided in the original configuration. Thus, multiplexer 42 receives as one of its inputs the conventional voltage $V_5$, and new voltage $V_5^-$, and provides an output $V_5'$ which is determined by a signal XTL from display controller 20'. Multiplexer 44 receives $V_0^+$ and $V_0$ and provides an output $V_0$ as selected by signal XTL from controller 20'. While multiplexers 42 and 44 are shown as two-in, one-out multiplexers, it is to be understood that other multiplexer formats can be used in accordance with the present invention, such as a single multiplexer which permits selection between two pairs of inputs, and provides the selected pair as its output.

Vertical compensation for LCD Segment 1 is provided through a similar multiplexing scheme represented by block 46. The selection between the normal or "boost" voltages is controlled by signal XTU from controller 20'. It is to be understood that instead of having a separate block 46, LCD segments 1 and 2 can actually share multiplexers 42 and 44, and only one of the signals could be required since the timing for these two signals could be the same.

Compensation data supplied on data bus 22 to the column drivers by the display controller 20' during the vertical retrace interval determines whether or not the boost voltage is applied to a particular column for a particular retrace scan-line period.

During the active display portion of the display cycle, the XTL and XTU signals cause multiplexers 42 and 44, and the multiplexers in block 46, respectively, to supply the normal voltages $V_0$ and $V_5$ to the column drivers 12 and 16. During the retrace scan-line intervals, these XTU and XTL are asserted to "boost" these voltages to $V_0^+$ and $V_5^-$. The "+" and "−" values represent a delta above and below, respectively, the normal $V_0$ and $V_5$ voltages. The magnitude of the "deltas" must be the same in order to preserve an AC drive condition and thereby avoid damage to the display. The requirement for this is:

$V_0-V_1=V_4-V_5$, for the MOD=1, MOD=0, column ON, row non-active, cases, respectively, $V_1-V_2=V_3-V_4$, for the MOD=1, MOD=0, column OFF, row non-active, cases, respectively, and $V_0^+-V_1=V_4-V_5^-$, for the MOD=1, MOD=0, column ON, row non-active "boost" cases, respectively.

As to the former, with $V_0$ being "boosted" in the positive direction and $V_5$ being "boosted" in the negative direction, since $V_0$ and $V_5$ are both being changed equally, the required relationship is still satisfied.

As to the latter, since no changes are made to $V_1$ through $V_4$, there is no impact here.

Another requirement is to avoid damage to the column driver chips. In most cases the requirement is that $VCC \geqq V_0 \geqq V_1 \geqq V_2 \geqq V_3 \geqq V_4 \geqq V_5$. Since the "boost" voltages are being multiplexed to the $V_0$ and $V_5$ inputs of the column drivers, it is important that the above relationship is not violated. Since $V_5^-$ is more negative than $V_5$, then either the normal $V_5$ voltage or the $V_5^-$ voltage will satisfy this requirement.

In some cases the VCC (+5 v) and $V_0$ are hooked together. This is because $VCC \geqq V_0$ is permitted. However, if $V_0^+$ is provided which is higher than VCC, this condition will be violated. In order to avoid this, the $V_0$ should not be connected to VCC (although the $V_0^{30}$ could be connected to VCC, assuming $V_0^+$ is at a proper voltage level, e.g. 5 V). $V_0$ would then be reduced to VCC minus the delta voltage ($V_0^+$–$V_0$), and this usually will mean that in order to achieve the same operating voltage levels, the negative voltage supply will be reduced accordingly. None of this presents a problem to the LCD display or the drivers or the operation or screen quality. Only a shifting of the operating voltages is occurring in accordance with the present invention.

A further requirement is that the "delta voltages", i.e. magnitude above or below the normal $V_0$ and $V_5$, are sufficiently low to avoid the maximum rating of the column drivers. This is not generally a problem for current state of the art drivers since the delta voltages in accordance with the present invention will be generally less than 2 v (4 v total).

When the present invention is implemented by way of modifying a conventional LCD drive system, beyond the need for additional multiplexers to select between the "boost voltages" and normal voltages, there is a need to generate the extra-2 "boost" voltages ($V_0^+$ and $V_5^-$). Most of the LCD panel manufacturers generate the 6 LCD voltages in a small analog IC. To generate these additional $V_0^+$ and $V_5^-$ voltages, an additional dual operational amplifier and miscellaneous resistors and capacitors are used. Alternatively, an analog IC voltage generator can be used which has been internally modified to provide the two additional "boost" voltages. It is believed that such modifications are well within the ordinary skill in the art, and therefore no further details will be provided here as to such voltage generator.

FIGS. 8A and 8B shows the use of two sets of these $V_0^+$ and $V_5^-$ voltage generators and multiplexers for vertical compensation. However, it is to be understood that only one set of these $V_0^+$ and $V_5^-$ voltage generators and multiplexer are actually needed for vertical compensation, even for dual-scan LCDs. This is because, unlike horizontal crosstalk compensation which uses a voltage which is adjusted for each row, vertical crosstalk compensation of the present invention presents the boost voltages to the column drivers at predetermined intervals in the vertical retrace interval, and the compensation data is what selects from among these predetermined intervals the particular voltages and intervals which are actually applied to a particular column.

In other words, the normal voltages from voltage generator 24' and the boost voltages from multiplexers 42 and 44 can be supplied not only to column drivers 16, but also to column drivers 12. As a practical matter, however, use of a single voltage generator/multiplexer set will mean that twice the number of columns will be driven by the one set, which in turn may require that output stages be able to handle larger loads.

Separate multiplexers are used for row compensation by each panel half for dual-scan panels, as illustrated in FIGS. 8A and 8B. This is because a row from the upper segment is compensated at the same time as a row from the lower segment, and the magnitude of the boost voltage needed may be different between the two rows. Conversely, a single scan panel only requires one multiplexer for row compensation.

For LCDs which have "shared" row drivers provisions are made to ensure that the row drivers do not "see" these "compensation line clocks". Many of these LCDs have a special gate-array which performs this blocking already. This gate array is removed and the display controller 20' of the present invention is assigned the task of supplying the MOD signal and supplying a separate CP1-ROW signal which will only be active during "normal" display times.

Figure 9:
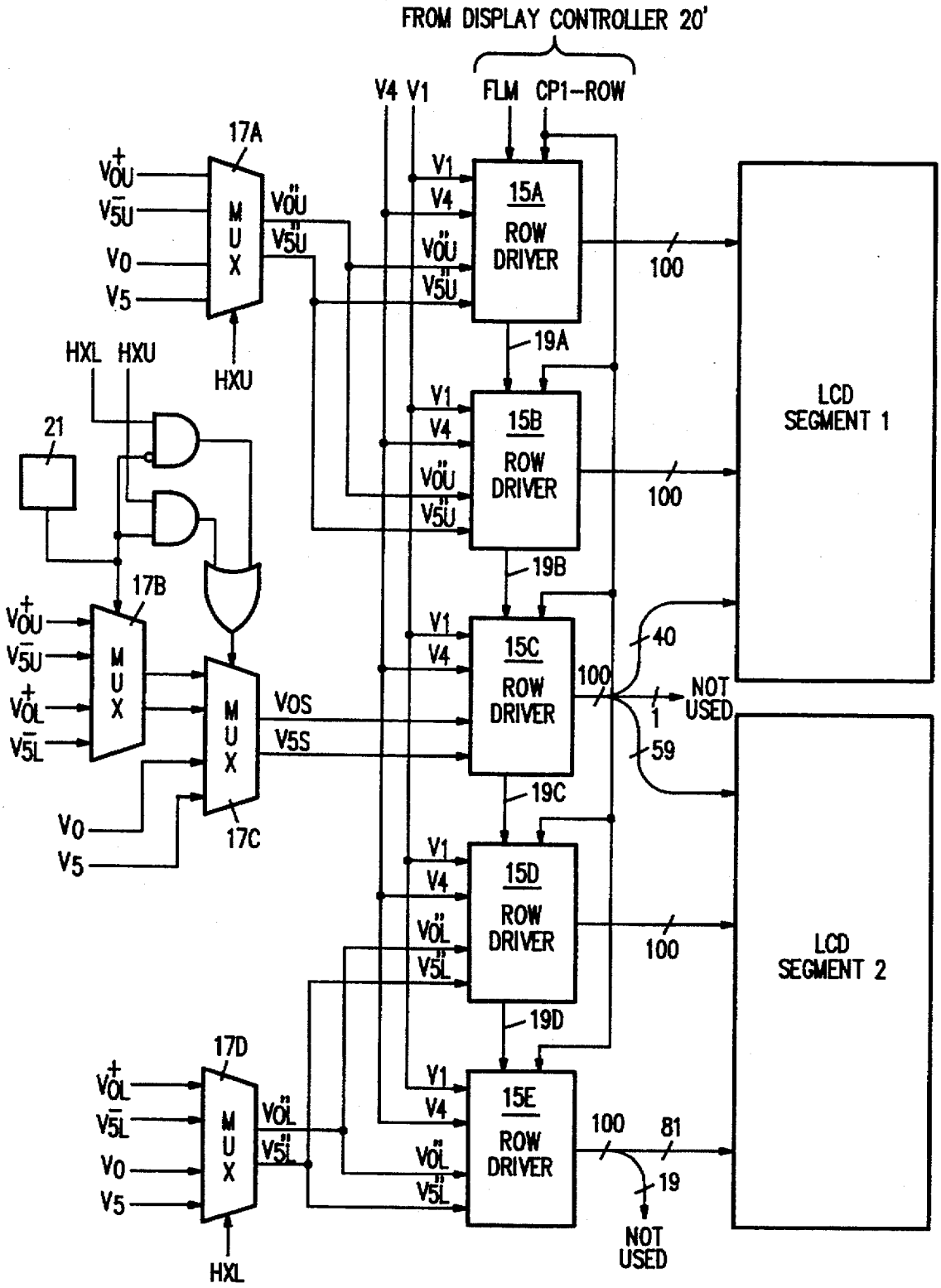
FIG. 9 illustrates a "shared" row driver LCD dual panel system receiving boost voltages in accordance with the present invention.

Shared Row Drivers:

FIG. 9 illustrates a "shared" row driver LCD dual panel system. Column drivers and control signals to the row drivers are not shown in order to simplify the explanation. In this example, the row drivers 15A through 15E each drive 100 rows. Thus, five such drivers are utilized, with the driver 15C being "shared" by LCD segment 1 and LCD segment 2.

Display controller 20' supplies the FLM (first line marker) and CP1-ROW (line clock) to the row drivers 15A–15E. It is to be noted that CP1-ROW would be used instead of the CP1 signal which is normally connected to the row drivers. The column drivers would still be driven by CP1. When the FLM bit has been shifted through row driver 15A, thus completing the scanning of its associated 100 rows, the FLM bits is supplied to row driver 15B, via line 19A, to be shifted through row driver 15B, and thence to and through the first 40 lines of row driver 15C.

For the bottom segment, LCD segment 2, scanning starts by inserting the FLM signal so that the 42nd output of row driver 15C is initially driven. The FLM signal is then shifted through row driver 15C, and is thereafter shifted to and through row driver 15D, then row driver 15E.

In this manner, corresponding rows in LCD segment 1 and LCD segment 2, are scanned at the same time. When the top rows of the LCD segments are being scanned, row driver 15C is driving rows in segment 2. When the bottom rows of each segment are being scanned, row driver 15C is driving rows in segment 1. Thus, row driver 15C will be supplied with drive voltages meant for segment 2 during the first 59 lines of the frame, and thereafter the drive voltages it receives will be switched to those meant for segment 1. It is to be noted that pin 41 of row driver 15C is not used.

In the circuitry shown in FIG. 9, instead of using two-in, one-out multiplexers as was shown in the other embodiments of the invention, dual multiplexers 17A, 17B, 17C and 17D are used. It is to be understood that either type of multiplexer is suitable for use in the present invention.

Multiplexer 17A has a first pair of inputs, $V_{0U}^+$, $V_{5U}^-$, which are the boost voltages; and a second pair of inputs, $V_0$, $V_5$, which are the normal voltages. Signal HXU from the display controller 20' is applied to the select input of multiplexer 17A to select between the two pairs of inputs, with the boost voltage pair being selected during the vertical retrace portion of the display cycle. The outputs of multiplexer 17A, $V_{0U}''$ and $V_{5U}''$, are supplied to row drivers 15A and 15B, which drive LCD segment 1. Similarly, multiplexer 17D, selects between voltage pairs $V_{0L}^+$, $V_{5L}^-$, and $V_0$, $V_5$, as designated by signal HXL from display controller 20'. The selected pair is supplied as voltages $V_{0L}''$ and $V_{5L}''$ to row drivers 15D and 15E.

Finally, the shared row driver 15C is supplied with voltages $V_{0S}$ and $V_{5S}$ from multiplexer 17C. These voltages are selected from pairs $V_0$, $V_5$ and the pair of outputs from multiplexer 17B. The select signal to multiplexer 17C is the logical OR of signals HXL and HXU. Thus, whenever either of those signals is asserted, indicating that a boost voltage is desired, multiplexer 17C selects for its output, the boost voltage pair from multiplexer 17B. When neither HXL or HXU is asserted, the normal voltages $V_0$ and $V_5$ are supplied by multiplexer 17C.

Multiplexer 17B has voltage pairs $V_{0U}^+$, $V_{5U}^-$ and $V_{0L}^+$, $V_{5L}^-$ as its inputs, and receives a select signal from block 21. Block 21 provides a switch signal which is a function of to which LCD segment it is supplying a drive signal. For example, block 21 can be a signal which changes state when output 1 of row driver 15C goes active, and reverts back to the original state when output 41 of row driver 15C goes active. Alternatively, block 21 changes the state of its output when row 60 of segment 2 is reached and reverts to the original state at any point after the final line of driver 15C (line 59 of segment 2) is driven. Multiplexer 17C is controlled by an "OR gate". One input of this OR gate is driven by the "AND" of the block 21 signal with HXU, while the other input to this OR gate is driven by the AND of HXL with the alternate state of the signal from block 21.

Compensation Signal Format:

Returning now to FIGS. 8A and 8B, and in light of the above, it can be seen that the signals XTL and XTU from controller 20' can dictate the whether a boost voltage is supplied for a particular retrace scan-line, and if the so duration of the boost voltage within that particular retrace scan-line, and therefore the amount of boost available from each retrace scan-line. Likewise, when a single voltage generator 24, multiplexer 42/44 set is used, a single signal, XT, from display controller 20' can control the timing. By varying the duration of the boost voltage versus the normal voltage within a retrace scan-line, from one line to the next, a pulse-width-modulation technique can be used to set the total RMS (root-mean-square) voltage level of the compensation applied to a column.

Figures 10A, 10B, 10C, 10D:
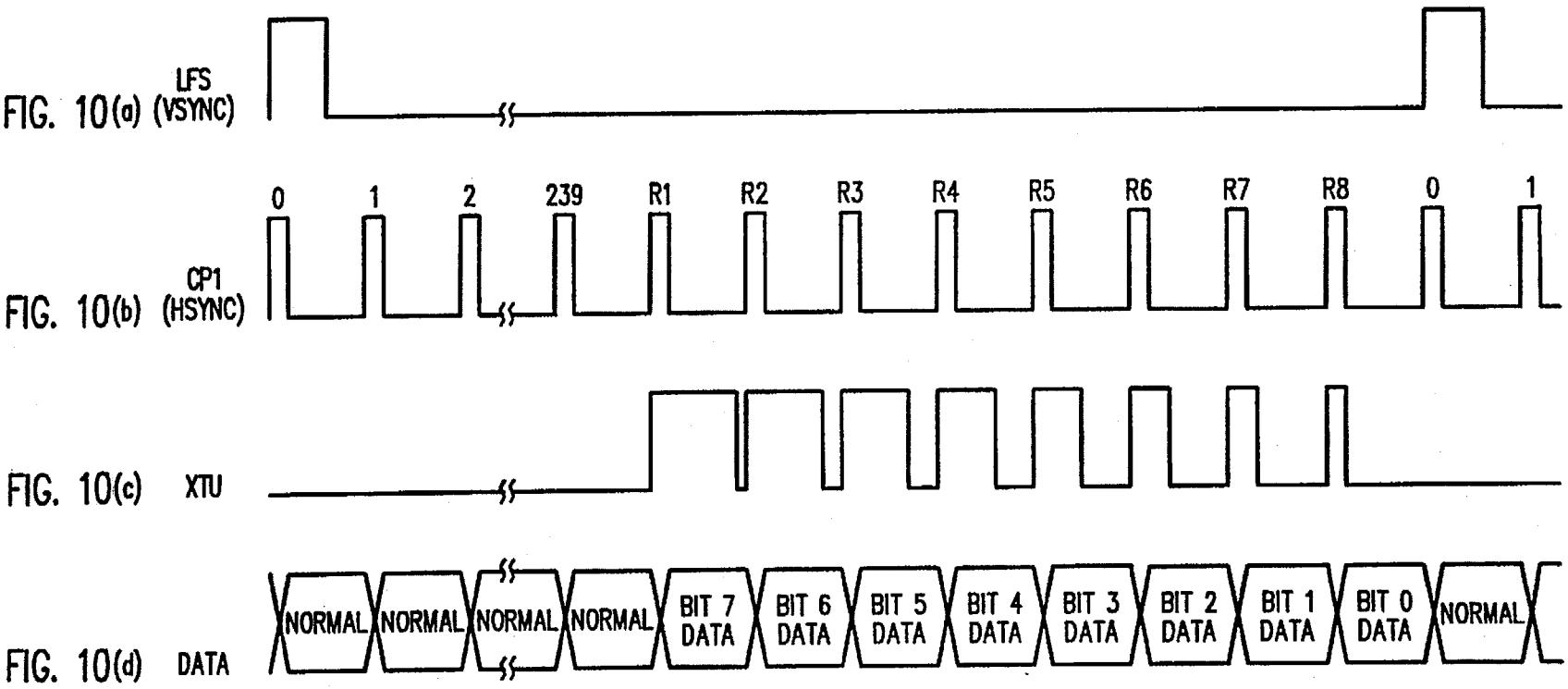
FIGS. 10(*a*)–(*d*) illustrate the portion of the display cycle within which vertical compensation is effected in accordance with the present invention using a pulsewidth modulation approach.

FIGS. 10(*a*)–(*d*) illustrate the portion of the display cycle within which vertical compensation is effected using this pulsewidth modulation approach. FIG. 10(*a*) illustrates the vertical sync pulse (also known as first line marker, and LCD frame start), while FIG. 10(*b*) shows the horizontal sync signal. Note that the pulses labelled R1, R2, etc., represent retrace scan-lines. These retrace scan-lines are present during a delay period which occurs between the completion of active scanning of the LCD and before scanning is resumed of the first row of the next frame of data. The other pulses in FIG. 10(*b*), labelled with plain numerals, represent the periods in which the rows are being actively scanned.

FIG. 10(*c*) represents the control signal XTU from display controller 20'. Note that for the PWM approach being illustrated, XTU is not asserted during the active scanning periods, but is asserted for different fractions of the retrace scan-line periods.

FIG. 10(*d*) illustrates data from the display controller 20'. The "normal" notation signifies normal display data to be used during the active scanning portions of the cycle, while the "bit x data" indicates compensation data which indicates whether the boost voltage should be applied to a column over the particular retrace scan-line period.

Figures 11A, 11B, 11C, 11D, 11E:
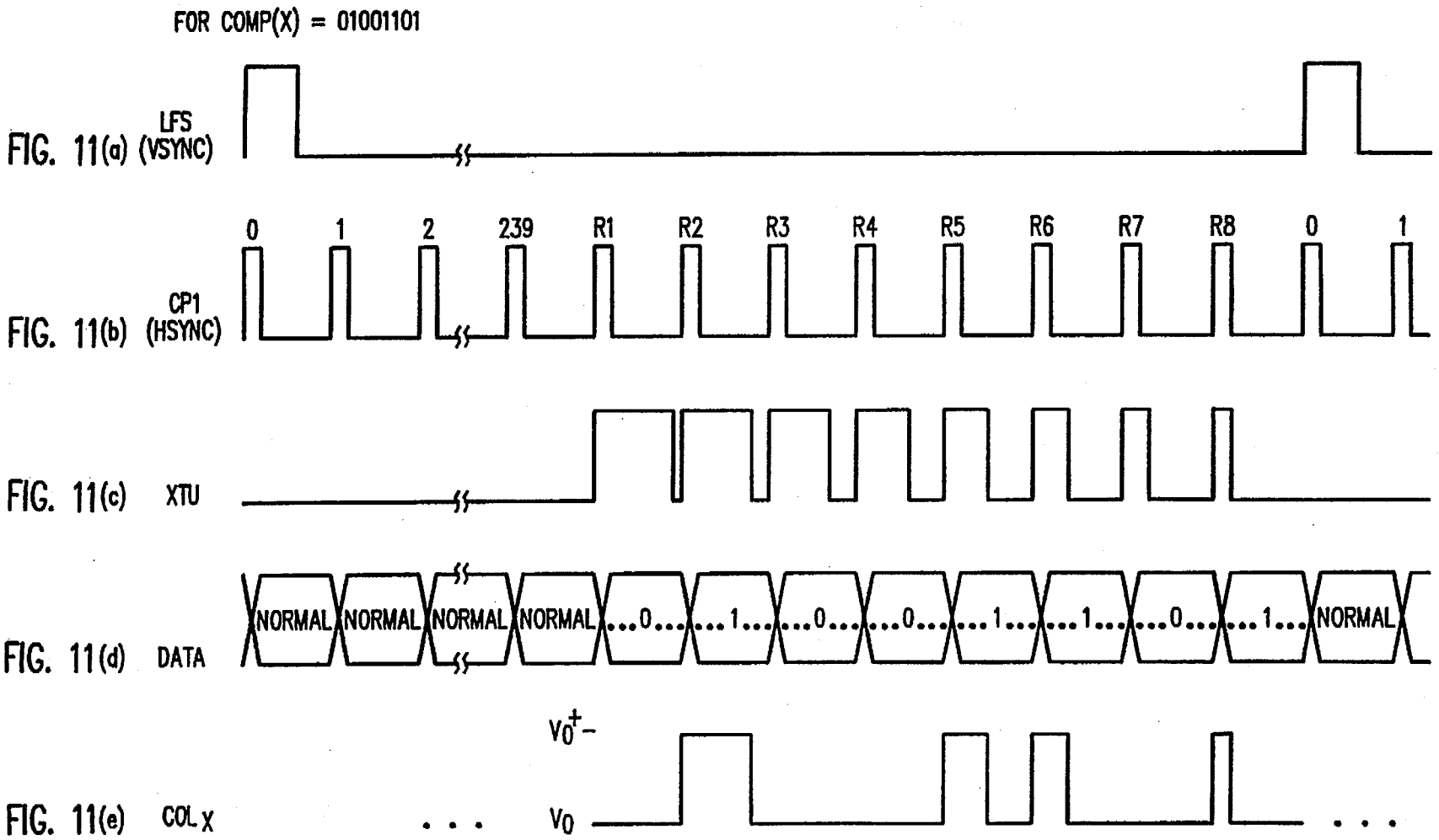
FIGS. 11(*a*)–(*e*) illustrates the pulsewidth modulation approach of the present invention for compensation data, 01001101, for column "X".

An example of such compensation is provided in FIGS. 11(*a*)–(*e*), where FIGS. 11(*a*)–(*c*) are identical to FIGS. 10(*a*)–(*c*), and FIG. 11(*d*) illustrates the compensation data for column "x", of 01001101. FIG. 11(*e*) illustrates the actual boost signal applied to column "x" as a result of the compensation data. As can be seen from FIG. 11(*e*), the boost voltage, $V_0^+$ is applied to column "x" during the R2, R5, R6, and R8 retrace scan-line periods. In this manner, the duration over which the boost voltage is applied to a column can be "binary weighted", as illustrated in the following Table 4. It is to be understood that more or fewer retrace scan-lines can be used and different pixels durations can be employed within the spirit of the present invention.

TABLE 4

| COMPENSATION SCANTIME | PIXEL DURATION |
|---|---|
| 1 | 512 |
| 2 | 256 |
| 3 | 128 |

TABLE 4-continued

| COMPENSATION SCANTIME | PIXEL DURATION |
|---|---|
| 4 | 64 |
| 5 | 32 |
| 6 | 16 |
| 7 | 8 |
| 8 | 4 |

The time period (PD) associated with each scan line may be determined in accordance with the following formula (where there are N compensating scan lines, numbered 1 through N):

$$PD = \frac{C - 2^M}{2^L}$$

where

PD is expressed in number of pixels periods;

C=the number of columns in the panel;

M=an integer less than N; and

L=the compensating scan line number.

It is to be noted in FIG. 11(*e*) that data for each of the columns is presented to the column drivers 12 and 16 by the display controller 20' for each of the retrace scan-line periods, R1, . . . , R8. In other words, the data sent from the display controller 20' to the column drivers 12 and 16 will be as set forth in Table 5:

TABLE 5

| Retrace scan-line: | Data sent to the display (columns 0 to 639) |
|---|---|
| 1 | comp(0)-bit7, comp(1)-bit7, . . . , comp(639)-bit7 |
| 2 | comp(0)-bit6, comp(1)-bit6, . . . , comp(639)-bit6 |
| 3 | comp(0)-bit5, comp(1)-bit5, . . . , comp(639)-bit5 |
| 4 | comp(0)-bit4, comp(1)-bit4, . . . , comp(639)-bit4 |
| 5 | comp(0)-bit3, comp(1)-bit3, . . . , comp(639)-bit3 |
| 6 | comp(0)-bit2, comp(1)-bit2, . . . , comp(639)-bit2 |
| 7 | comp(0)-bit1, comp(1)-bit1, . . . , comp(639)-bit1 |
| 8 | comp(0)-bit0, comp(1)-bit0, . . . , comp(639)-bit0 |

where, comp(x)-bit"y" is the "yth" bit of the compensation signal for column "x". In other words, the first 640 bits of compensation data sent corresponds to bit 7 of the compensation word for all 640 columns; and similarly, the last 640 bits of compensation data sent corresponds to bit 0 for all of the columns.

Vertical crosstalk compensation data is sent to the LCD column drivers just as other data is sent to the active screen, but during the vertical retrace period. The data is packed into 4-bit nibbles and provided on the normal LCD 4-bit data outputs and clocked with the SHIFT CLK (CP2). When all 640 bits (160 shift-clocks) have filled the line, the LINE CLK (CP1) strobes the data onto the LCD.

The resulting boost signals are thus active during each of the 8 retrace scan-lines but, only for a portion of the scan-line interval. So, during compensation retrace scan-line 1, comp(x)-bit7 (most significant bit) will be presented to the LCD for 512 pixel times, and for the remainder of the scan time the multiplexers 42 and 44 (and the multiplexers in block 46) will be switched back to the normal retrace scanning voltage by the XTU and XTL signals. During scantime 2, bit-6 of the comp(x) data will be presented for a shorter time (256 pixel times) and the effect will be ½ of the bit-7 value, and so on, for all 8-bits and retrace scan-lines. So, in effect a D/A conversion is being provided, but, instead of using a D/A converter, a boost voltage is being used which is PULSE WIDTH MODULATED to provide essentially the same RMS value of a true analog voltage. This saves interface pins and cost.

The row drivers 14 and 18 also receive this CP1 clock, but, since they are driving nonexistent rows, the LINE CLK (CP1) will have no effect on the row drivers. For the "shared row driver" case, the CP1-ROW signal will stop at the unused line (line 41) of the shared row driver 15C.

Figures 12A, 12B, 12C, 12D, 12E:
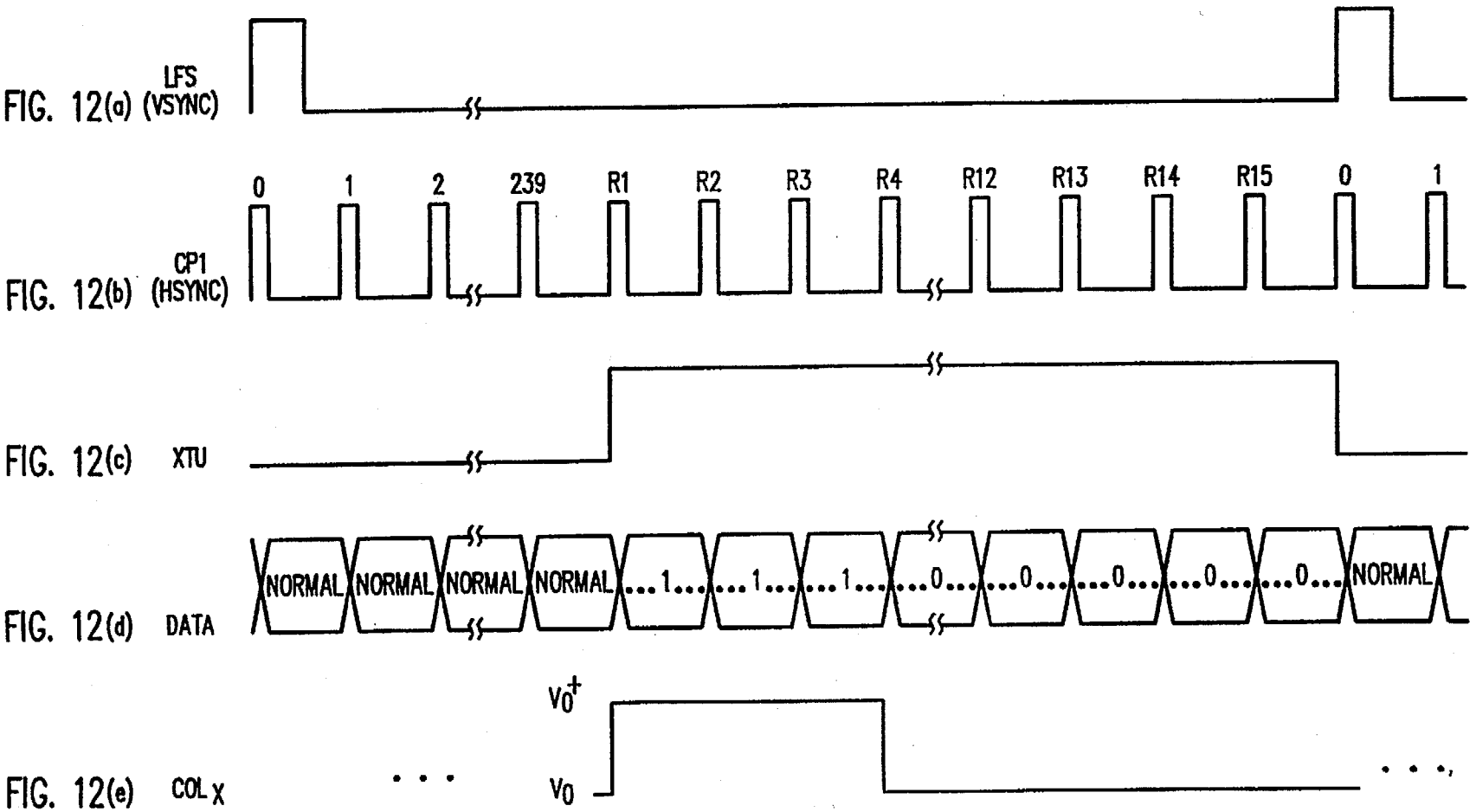
FIGS. 12(*a*)–(*e*) illustrate an alternative compensation approach in accordance with the present invention where 0 up through fifteen identical retrace scan-line intervals of a single "boost" voltage are selectable to form the compensation signal.

Alternatively, the boost voltages can be made available over the entire duration of N retrace scan-line periods so that the boost signal applied to a column can provide from one, up to N, retrace scan-line periods of the boost voltage. This is illustrated in FIGS. 12(*a*)–(*e*) for column x, and the compensation data: 1110 . . . 000, for N=15. Thus, in this example, the crosstalk compensation signal applied to column x is three retrace scan-lines long, at a voltage of $V_0^+$. Note that XTU is asserted for the entire 15 retrace scan-lines.

A variation of this latter approach is to use several different boost voltage levels so that combinations of a number of retrace scan-line periods and boost voltages will yield more gradations of boost signal magnitudes. For example, in addition to using boost voltage $V_5^-$, a boost voltage, $V_5^-/2$, can be used which is halfway between $V_5^-$ and $V_5^-$. The corresponding boost voltages for the other MOD state would be $V_0^+$, and $V_0^+/2$. Such combinations for boost voltages of $V_5^-$ and $V_5^-/2$, and 16 retrace scan-line periods, are shown in Table 6 below:

TABLE 6

| Active Retrace Scan-lines $V_5^-$ | $V_5^{-/2}$ | Compensation Level |
|---|---|---|
| — | R1 | ½ |
| R2 | — | 1 |
| R2 | R1 | 1½ |
| R2–R3 | — | 2 |
| R2–R3 | R1 | 2½ |
| R2–R4 | — | 3 |
| R2–R4 | R1 | 3½ |
| . | . | . |
| . | . | . |
| . | . | . |
| R2–R16 | R1 | 15½ |

Figures 13A, 13B, 13C, 13D, 13E, 13F, 13G:
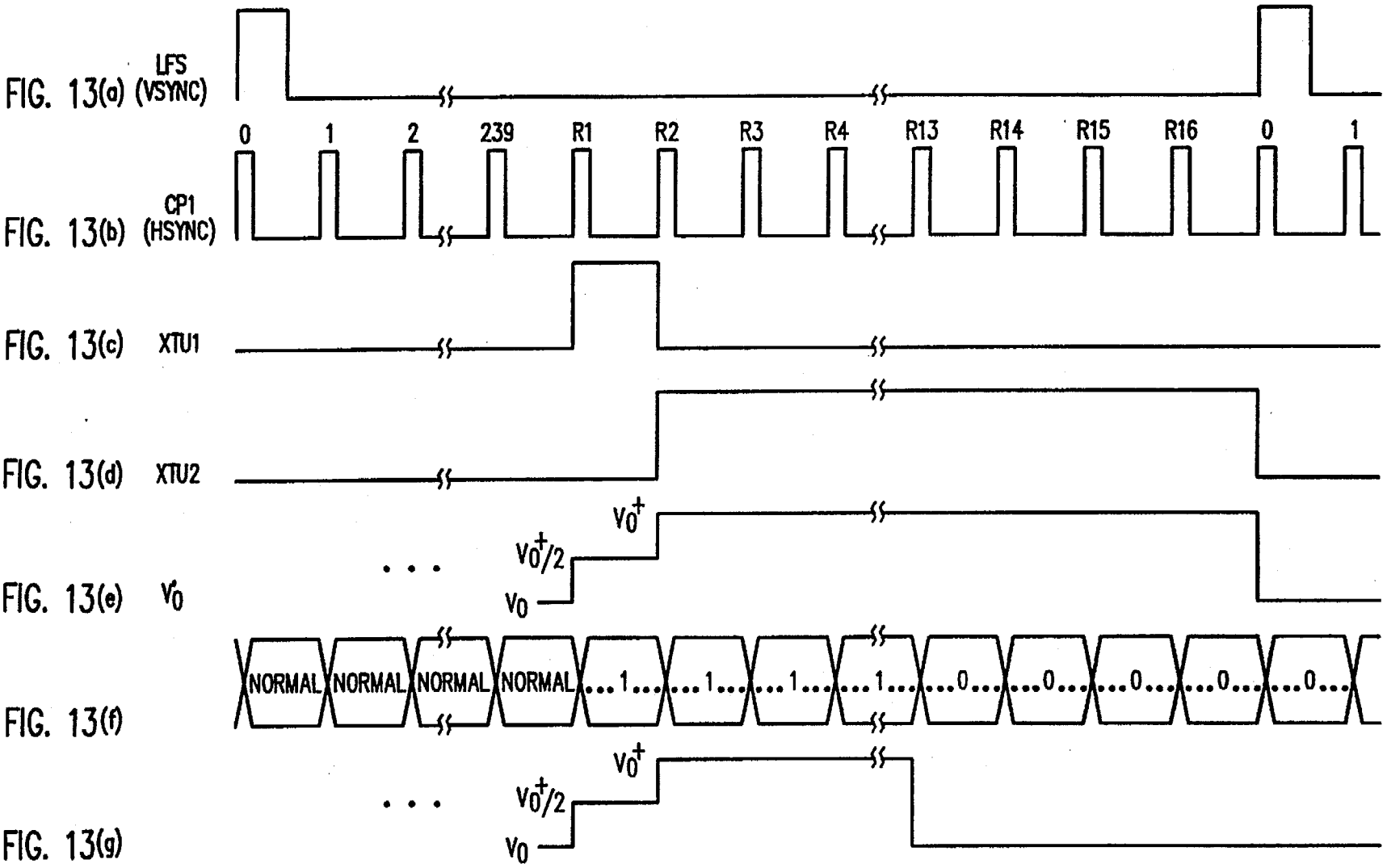
FIGS. 13(*a*)–(*g*) illustrate a further alternative for forming the crosstalk compensation signal using combinations of two different boost voltage levels and sixteen retrace periods.

FIGS. 13(*a*)–(*g*) provide an illustration of this approach.

In FIGS. 13(*a*)–(*g*) it is assumed that display controller 20' supplies two boost select signals, XTU1 and XTU2 for each LCD segment, see FIGS. 13(*c*) and 13(*d*), respectively. The designation "XTU" refers to the control signal issued by the display controller 20' for the upper haft of a dual scan LCD display, as shown in FIGS. 8A and 8B, while the designation "XTL" refers to the control signal for the lower haft of the dual scan LCD display. As discussed earlier, it is also possible to use a single voltage generator 24, and a single multiplexer set 42, 44, for vertical compensation of a dual scan display. In that case, the signal from the display controller 20' would be a single signal, such as "XT".

In the present example using the circuitry of FIGS. 8A and 8B, XTU1 and XTU2 designate the boost voltages as set forth in Table 7.

TABLE 7

| XTU1 | XTU2 | VOLTAGE |
|---|---|---|
| 0 | 0 | Normal |
| 0 | 1 | $V_0^+$ |
| 1 | 0 | $V_0^+/2$ |
| 1 | 1 | — |

FIG. 13(*e*) shows that XTU1 and XTU2 are set so that the half-boost voltage is available to be selected in the first retrace scan-line R1, and thereafter, the full boost voltage is available in the subsequent retrace scan-lines R2 through R16. See FIG. 13(*e*). The compensation signal example illustrated in FIGS. 13(*f*) and 13(*g*) shows the half-boost voltage being selected, and the full-boost voltage being selected for eleven (R2 through R12) of the following line refresh periods, for a total compensation signal of 11½.

While XTU1 is shown asserted during retrace scan-line R1, it can be asserted at other times, such as R16, within the spirit of the present invention.

Figures 14A, 14B, 14C, 14D, 14E, 14F:
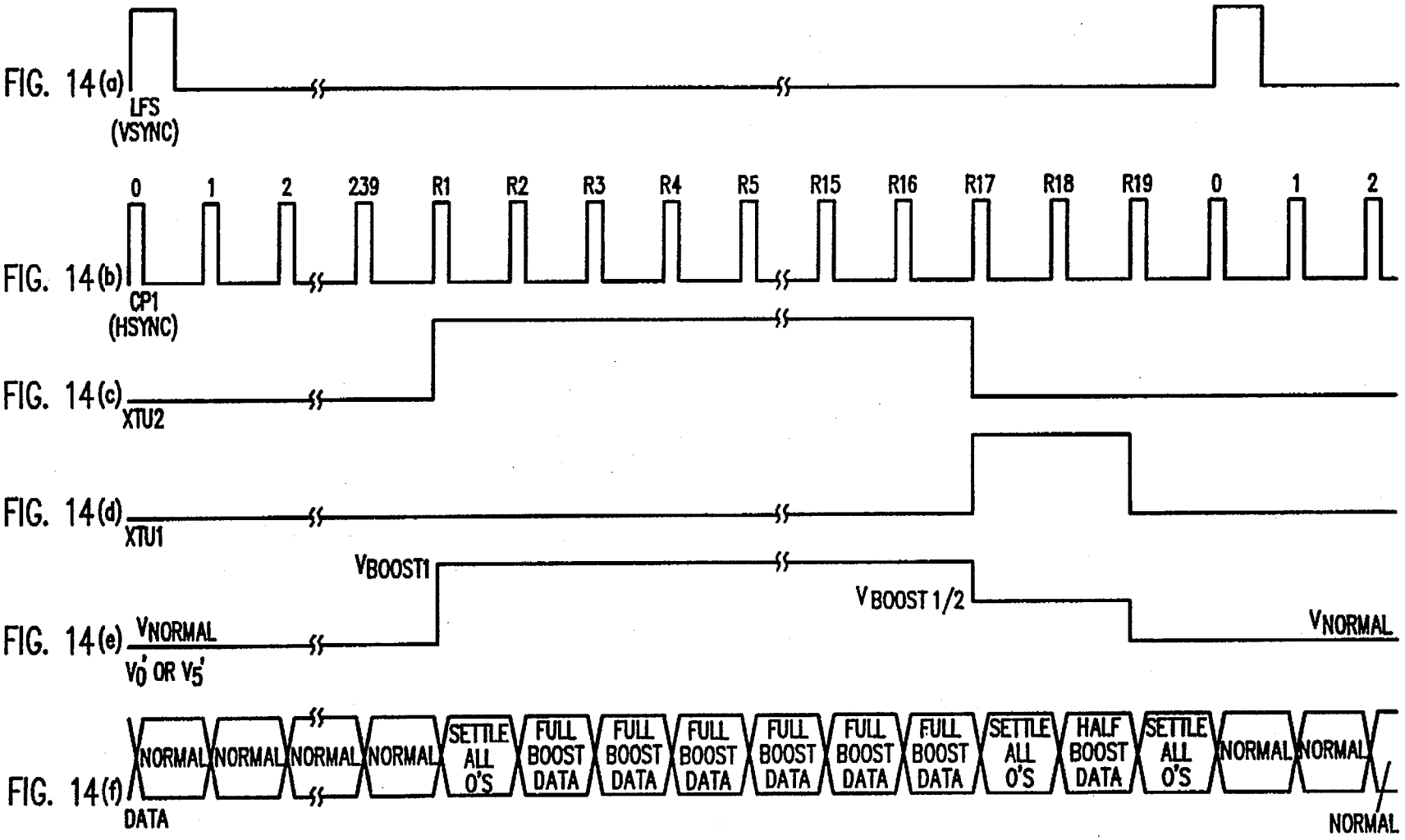
FIGS. 14(*a*)–(*f*) illustrate the use of selected retrace scan-line intervals to permit the boost and normal voltages to "settle" prior to applying those voltages to the LCD.

It is to be noted that the retrace scan-lines are selected in a consecutive sequence, rather than at random. This is to minimize the capacitive effects of the LCD. By making the selection so that there is a minimum of transitions in the compensation signal, voltage losses are further minimized. In this same vein, by supplying the "boost" voltages to the column drivers and allowing them to settle before applying them to the columns, transition losses can be kept to a minimum and damaging DC operation of the LCD can be minimized. Thus, one such protocol is set forth in Table 8 and illustrated in FIGS. 14(*a*) through 14(*f*).

TABLE 8

| Retrace Scan-line | Comp. Data | Voltage Sent |
|---|---|---|
| R1 | all 0 | $V_{boost1}$ |
| R2–R16 | actual comp. data | $V_{boost1}$ |
| R17 | all 0 | $V_{boost½}$ |
| R18 | actual comp. data | $V_{boost½}$ |
| R19 | all 0 | $V_{normal}$ |

In Table 8, nineteen retrace scan-lines are used for the "boost" voltage application step. See FIG. 14(*b*). During retrace scan-line R1, $V_{boost1}$ ($V_0^+$ or $V_5^-$) is applied, FIG. 14(*e*), but with the compensation data all set to zero which causes the column drivers to select either $V_2$ or $V_3$, FIG. 14(*f*). This permits $V_{boost1}$ ($V_0^+$ or $V_5^-$) to settle before actually being used to form the compensation signals in retrace scan-lines R2–R16. Then in retrace scan-line R17, the compensation data are again all set to zero, while $V_{boost1/2}$ ($V_0^+/2$ or $V_5^-/2$) is supplied and permitted to settle. Retrace scan-line R18 is then used to apply the half-boost signal to the columns, FIG. 14F. Finally, retrace scan-line R19 is used to permit $V_{normal}$ ($V_0$ or $V_5$) to settle.

Figure 15A:
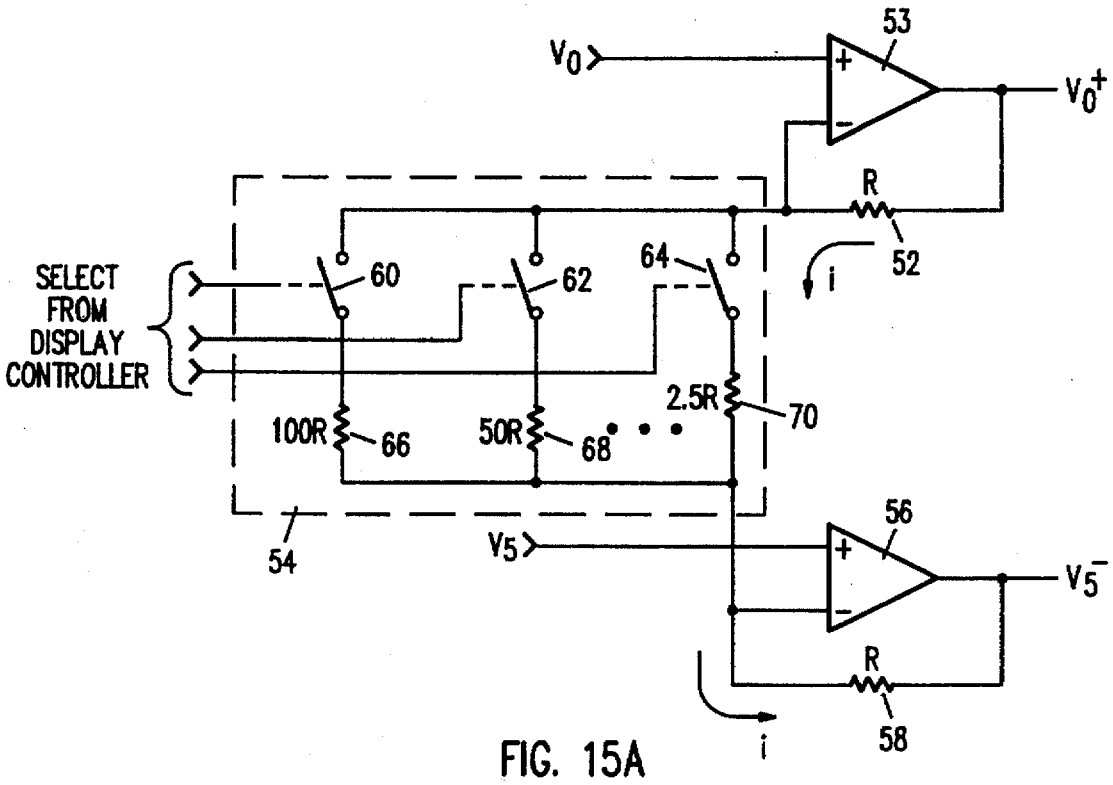
FIGS. 15A and 15B illustrate circuitry by which different levels of boost voltage can be obtained while meeting the requirement that the DC voltage across a pixel be minimized.

Boost Voltage Generator:

FIG. 15A illustrates a circuit by which different levels of boost voltage can be obtained, while meeting the requirement that the DC voltage across a pixel be minimized. The illustrated circuit shows the generation of boost voltages $V_0^+$ and $V_5^-$. Operational amplifier 53 is connected like a non-inverting amplifier with a feedback resistor, except that the current through feedback resistor 52 is determined by the current through selection block 54. Similarly, operation amplifier 56 is also connected as a non-inverting amplifier but with the current through its feedback resistor 58 being determined by the current flowing through selection block 54, and therefore is identical to the current flowing through feedback resistor 52. Both feedback resistors 52 and 58 are precision resistors, and therefore, the voltage drop across them will be nearly identical.

In this manner, the amount by which the output of operational amplifier 53 is above its input, will be nearly identical to the amount by which the output of operational amplifier 56 is below its input. More particularly, assuming that $V_0$ is applied to the non-inverting input of operational amplifier 53, the inverting input will be at $V_0$. With $V_5$ applied to the non-inverting input of operational amplifier 56, it's inverting input will be at $V_5$. This sets up a voltage difference of $V_0$–$V_5$ across selection block 54. Switches 60, 62, and 64 are controlled by boost voltage selection signals from the display controller 20', e.g. XTU1/XTU2 in the case of FIGS. 13(*a*)–(*g*). This determines the resistance of the selection block 54, which, in turn, sets the current that flows through feedback resistors 52 and 58. In this manner, an offset voltage ($I \times R_{sel.\ block}$) is created across feedback resistors 52 and 58 which is identical in magnitude and opposite in polarity. $V_0^+$ will be greater than $V_0$ by the offset, and $V_5^-$ will be lower by the magnitude of the offset. Therefore, there is a minimization of the DC component introduced across a pixel due to the use of "boost" voltages.

Select block 54 is shown with resistors 66, 68, and 70 which can be selected so that different combinations of them can be placed in parallel. It is to be understood that fewer or additional resistors and switches can be utilized to obtain the desired degree of offset. Furthermore, the magnitudes of resistors 66, 68, and 70 are preferably selected as ratios of feedback resistors 52 and 58 to provide the desired gradations of voltage offset.

Preferably, switches 60, 62, and 64 are PMOS transistors (p-channel). See FIG. 15B. Further, in FIG. 15B, feedback resistors 52 and 58 are shown as 1% precision resistors. Greater or lesser precision may be needed depending upon the DC tolerance of the particular LCD. It is to be understood that the "precision" of the resistors actually used is selected so that the difference between the voltages across feedback resistors 52 and 58 will be low enough to satisfy the AC drive conditions for the particular LCD being used.

Figure 15B:
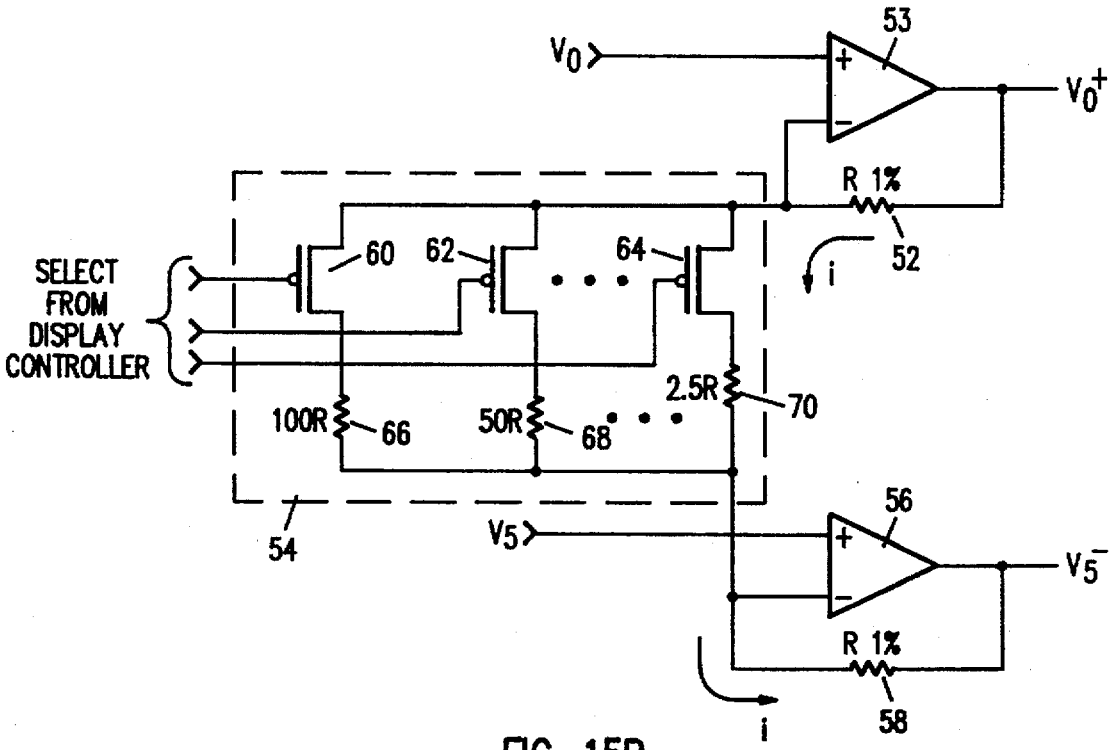
Figure 16:
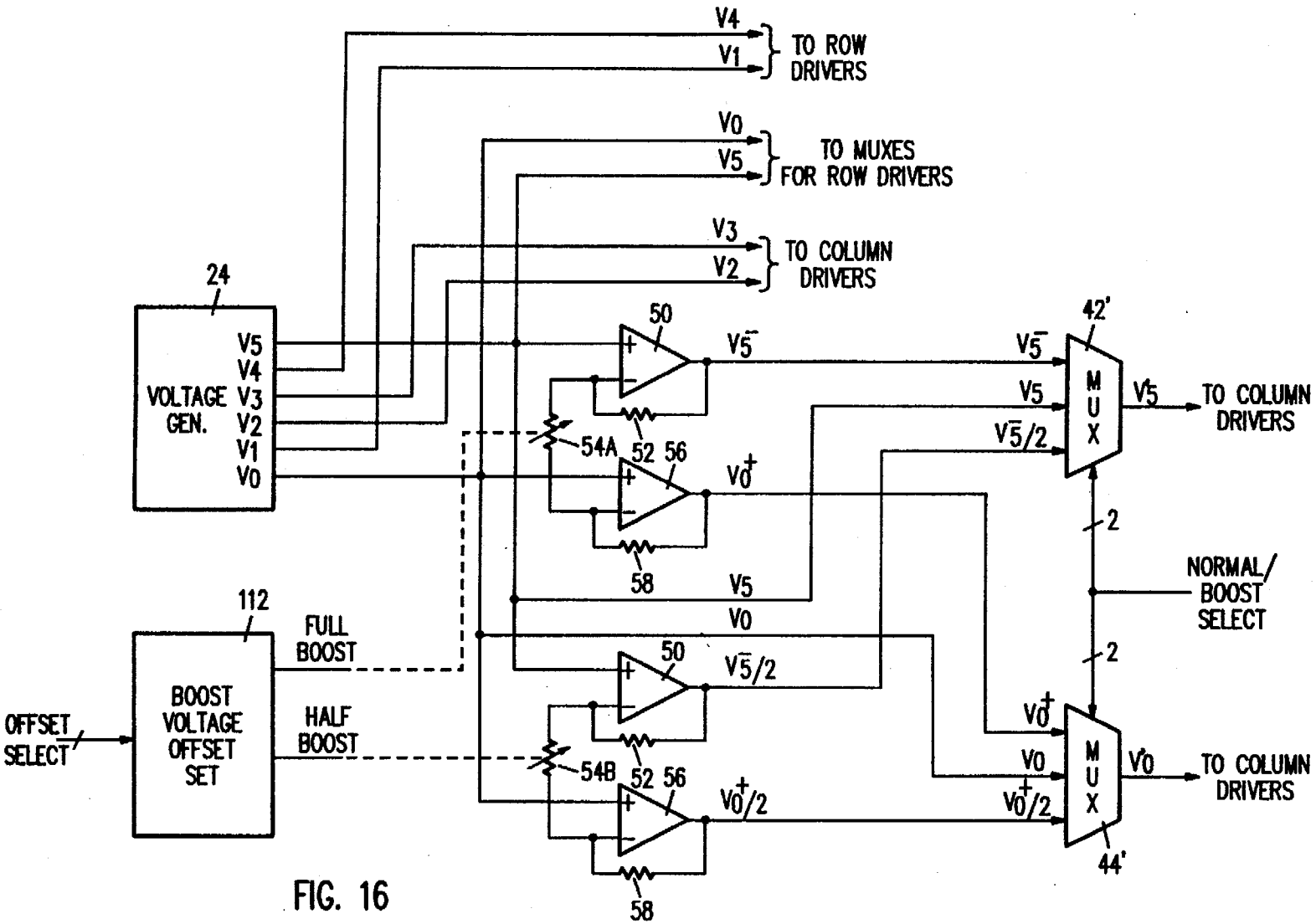
FIG. 16 illustrates how the circuit of FIGS. 15A and 15B can be employed to provide $V_0^+$, $V_0^+/2$, $V_5^-$, and $V_5^-/2$.

FIG. 16 illustrates how the circuit of FIGS. 15A and 15B can be employed to provide $V_0^+$, $V_0^+/2$, $V_5^-$, and $V_5^-/2$. Normal voltages $V_5$ and $V_0$ are supplied to the non-inverting inputs of amplifiers 53 and 56 respectively. The select block 54A is set by control signals from boost voltage offset select block 112 to cause a full boost to be generated. Boost voltage offset set 112 can be a latch or register which is loaded by display controller 20', or a set of dip-switches which are set by the user, or some other programmable mechanism.

As can be seen from FIG. 16, full boost voltages $V_5^-$ and $V_0^+$, are supplied to multiplexers 42' and 44'. Note that these multiplexers are three-in, one-out multiplexers. Boost voltage offset select block 112 provides control signals to select block 54B so that a half-boost set of voltages $V_5^-/2$ and $V_0^+/2$, are generated and supplied to multiplexers 42' and 44'. Finally, normal voltages, $V_5$ and $V_0$, are input to the multiplexers. In turn, multiplexers 42' and 44' receive a normal/boost select signal from display controller 20'.

Other Compensation Signal Alternatives:

A further alternative to applying "boost" voltages to the columns, is the use of digital to analog converters to generate the "boost" voltages, as in the horizontal compensation case.

Figure 17:
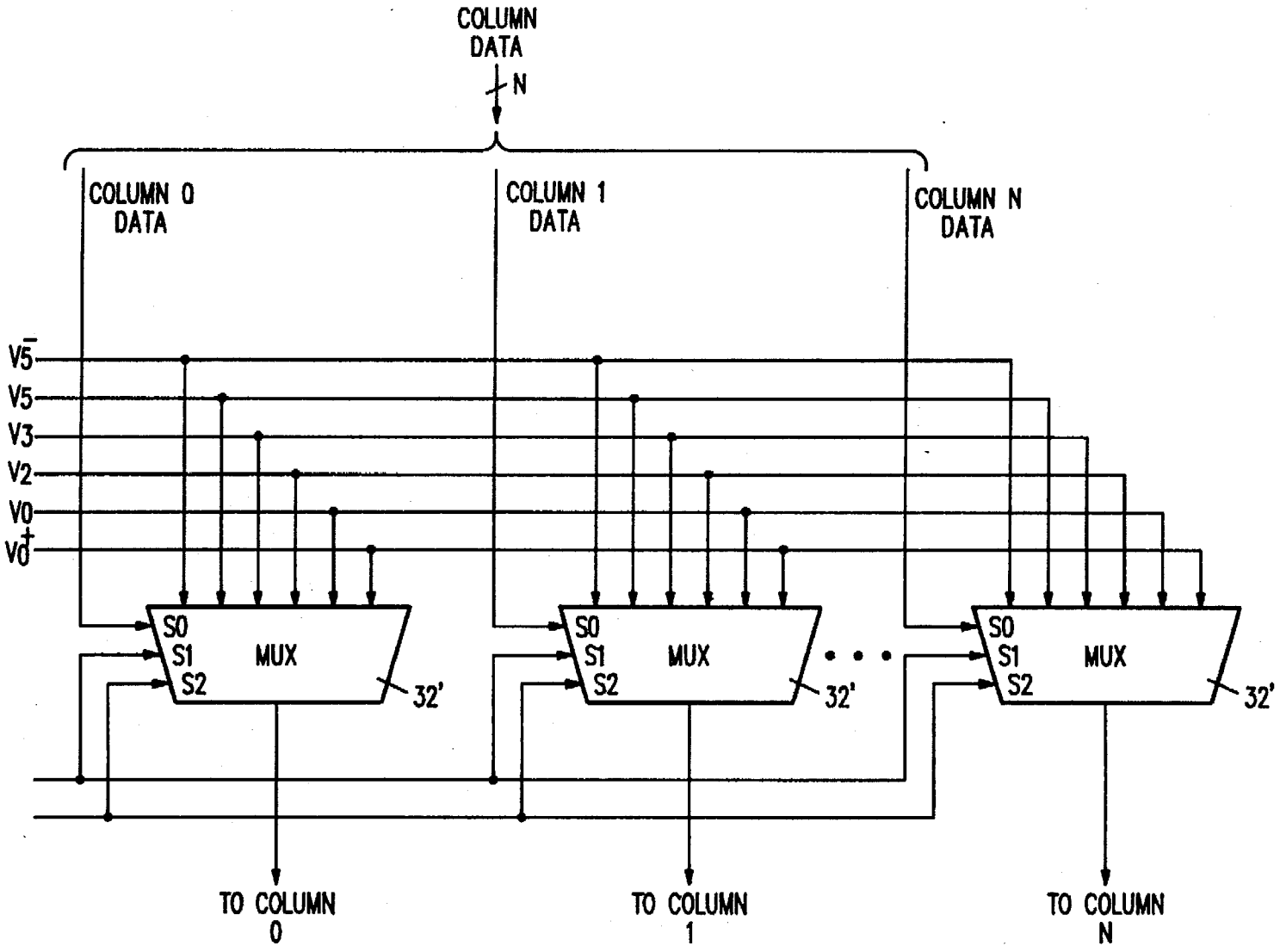
FIG. 17 illustrates an embodiment employing column drivers having additional drive voltage inputs for the single boost voltage case.

Another alternative is to provide new column drivers which are capable of handling more than the conventional four voltages. This would entail increasing the number of voltage input lines, and the number of select lines. FIG. 17 illustrates such an embodiment for the single boost voltage case. Inputs are provided by multiplexers 32' for boost voltages $V_0^+$ and $V_5^-$, in addition to the "normal" voltages $V_0$, $V_2$, $V_3$, and $V_5$. Furthermore, an additional select signal input, $S_2$, has been added. It is also understood that other signals (such as the half boost voltages) could be added as inputs to the column drivers within the scope of the present invention.

Variable "Normal" Voltages:

It has been observed that the intensity of a pixel in an LCD panel decreases with increasing distance of a pixel from a row driver and column driver. Thus, assuming that the row drivers are located along the left edge of the LCD panel, and the column drivers are located along the top edge, the pixels at the bottom right hand corner will be the dimmest. Thus, the degradation in pixel excitation voltages is more pronounced the further away is the pixel from the row and column drivers.

In accordance with a further embodiment of the present invention, the normal voltages used are increased as a function of distance from the row or column drivers. For the row drivers this means that the normal voltage applied to the rows is greater and greater the further away the row is from the column drivers. Thus, the normal voltage is lowest when the top row of panel is being scanned, and greatest when the last row is scanned.

Since D/A converters are already in use for horizontal compensation, the increasing of the normal voltage is obtained by adding a term to the expression for determining the horizontal compensation signal level:

$$V_{HCOMP}=H_{on}*kh1+\text{Row\#}*kh2+Vn,$$

where, $V_{HCOMP}$=horizontal compensation value; Row#= row number; and kh1 and kh2 are panel dependent constants dependent, for example, on how crosstalk in a particular panel varies with $H_{on}$ and Row#; and Vn is the "normal" ON voltage for a row, and $H_{on}$=# of ON pixels in a row.

Figure 18:
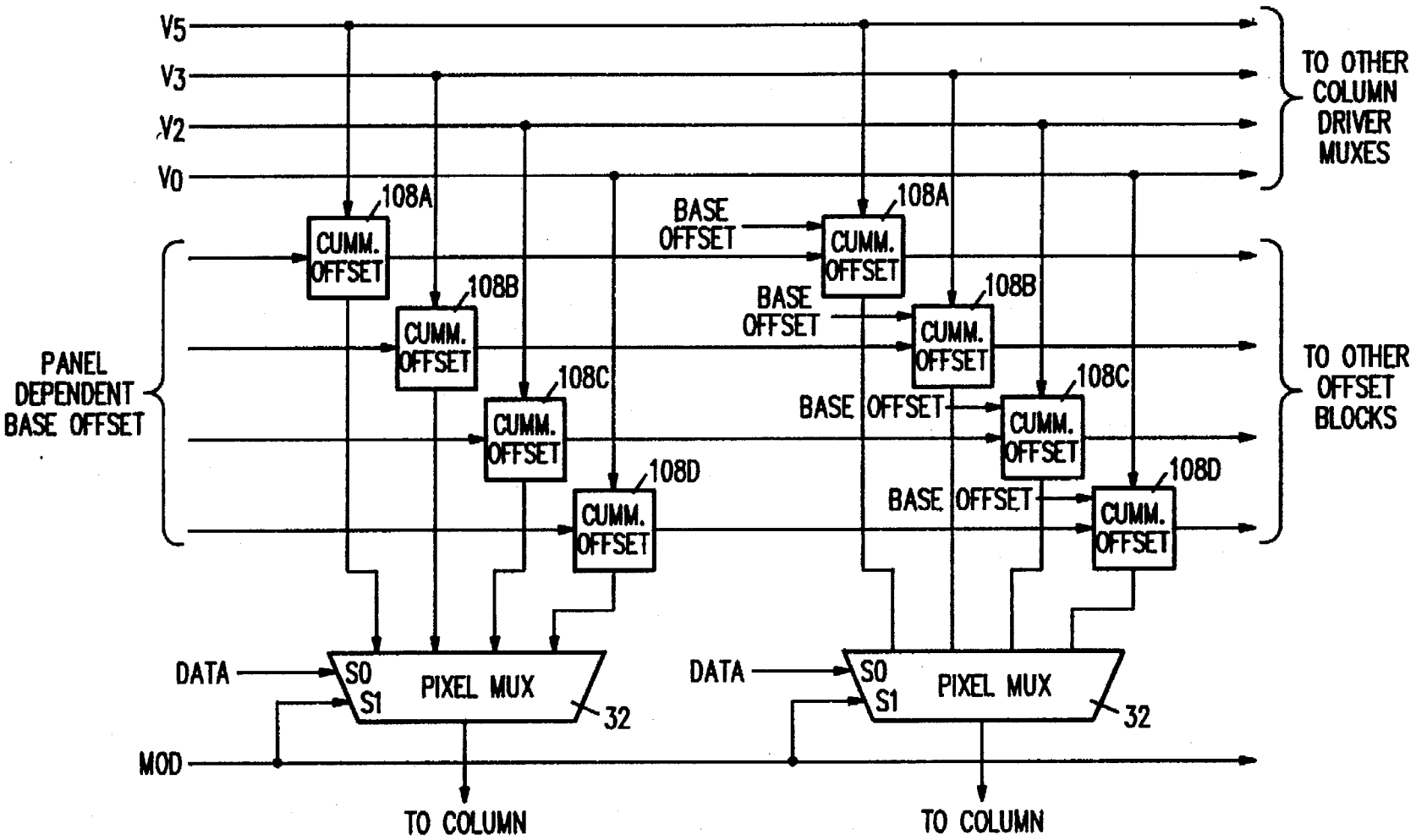
FIG. 18 illustrates an embodiment of the present invention in which the normal voltages supplied to the column drivers are increased as a function of distance from the row driver circuitry.

Adjustment of the column "normal" voltages is accomplished using modified column drivers which permit the application to the columns of an increasing "normal" voltage as the distance from the row drivers increases. FIG. 18 is illustrative, showing two of the individual multiplexers 32 in the 80 pixel multiplexer 30 of FIG. 2A. Each voltage input to multiplexer 32 is offset in a cumulative offset block, e.g. 108A. The cumulative offset blocks are shown cascaded, so that a offset voltage from an offset block for an upstream multiplexer 32 is passed on to the corresponding offset block for the next multiplexer 32 in the sequence. For example, the cumulative offset blocks 108B are shown cascaded. Thus, the offset for "normal" voltage $V_3$ which is produced by cumulative offset block 108B for the first multiplexer 32, is passed on to the cumulative offset block 108B for the second multiplexer 32 for use there in generating a slightly greater offset for "normal" voltage $V_3$.

A base offset, which is panel dependent, is supplied to each of the cumulative offset blocks.

When variable "normal" voltages are employed in driving an LCD, it is expected that vertical crosstalk compensation will be simplified. This is because this technique addressed the pixel position dependence of the crosstalk phenomena. Also, screen brightness uniformity is expected to improve. There may be other improvements as well.

Horizontal Crosstalk Compensation Details:

As was the case with vertical crosstalk, in accordance with the present invention, horizontal crosstalk is compensated. This is done by adding the appropriate voltage during the horizontal scanning interval. Although LCD display systems are similar to CRT display systems in that pixels are arranged by rows and columns, and scanned row-by-row, LCD display systems are also different in that they do not have a "horizontal retrace interval" since no "beam" is employed. Thus, the LCD horizontal scanning interval includes the interval over which a row of pixels is being actively scanned, and no "retrace" interval is needed or used. Because the column drivers 12 and 16 include shift registers 26 and latches 28, display data for the next row to be scanned are shifted into the column drivers 12 and 16, while the display data for the current row are supplied to the output multiplexers 30 by latches 28.

In FIGS. 8A and 8B, the boost voltages for horizontal crosstalk compensation are supplied to the row drivers 14 by additional analog multiplexers within upper segment row driver block 47, and to row driven 18 by multiplexers 49 and 51. However, because the magnitudes of the compensation signal may vary from row to row, different boost voltages are used. Thus, for example, for LCD segment 2, two D/A converters 48 and 50 are shown which provide horizontal compensation boost voltages for LCD segment 2 as a function of the digital words provided from pins HL of display controller 20'. Similarly, D/A converters in block 47 provide horizontal compensation boost voltages for LCD segment I as a function of the digital words provided from pins HU of display controller 20'.

The display controller 20' outputs a HU/HL signal at the appropriate times during the scanning interval and vertical retrace interval. One set of multiplexers are provided for each panel half, while the vertical compensation multiplexers can be shared between the upper and lower column drivers 12 and 16, respectively.

In accordance with one embodiment of the present invention, horizontal crosstalk compensation can be provided by applying a "boost" voltage for a time interval which is a function of the number of ON pixels in a line or row. This can include the pixels in a line or row during the active scan time, or all lines and rows which are energized during the vertical retrace time by the vertical compensation data. This is a pulse-width-modulation approach, and involves use of the "boost" voltages from voltage generator 24', and selectively applying the "boost" voltage or the normal voltage, as needed. For example, if 320 pixels (half of a line) are turned ON, then the "boost" voltage is applied for about "half" of the display time.

In practice, it is preferable to share one set of "boost" voltages between horizontal and vertical compensation circuitry, however, the full-scale requirements may not be exactly the same for both the horizontal and vertical compensation. The "boost" will be high enough to satisfy the worst-case boost voltage requirements of either Horizontal and Vertical, thus, some of the resolution may be lost for the case where less full-scale "boost" voltage is required.

The resultant total of the ON pixels for a row are stored in a latch and used immediately on the displayed line, while the counter begins counting the ON pixels for the next line. Recall that registers 26 in the column drivers receive display data for the next row, while latches 28 provide display data for the current row being scanned. Thus, while the display data for the next row are being shifted into registers 26, a count can be made by display controller 20' of the number of ON pixels that will be present in that next row, and the appropriate mount of time at which the "boost" voltage is applied for that next row can be determined, and thereafter supplied to the row driven 14 and 18 when that next row is being scanned.

It is to be understood that, in addition to the pulse-width-modulation technique described above, other techniques for applying a horizontal crosstalk compensation voltage to the rows can be employed in accordance with the present invention. These alternative techniques include setting D/A's, such as D/A converters 48 and 50, to a selected value, and holding that value over the entire active scan-line period. Alternatively, as discussed with the pulse-width-modulation technique above, the D/A compensation voltage could also be applied during the vertical retrace period when vertical compensation data is being applied in order to correct for the row loading effects. With this alternative technique, multiplexers, such as 49 and 51, can be dispensed with, and D/A converters 48 and 50 can be the source of both boosted and normal voltages. (As noted earlier, block 47 contains D/A converters and multiplexers for supplying horizontal compensation boost voltages for LCD segment 2.) Recall that the pulse-width-modulation technique used "fixed" boost voltage levels and varied the duration during the active scan-line over which the boost voltage was applied by way of controlling the selection of the "boost" or normal voltage through multiplexers 49 and 51.

It is to be understood that when a boost voltage is to be applied by the row driven during the vertical retrace period, appropriate modifications to the voltages $V_1$ and $V_4$ should be made in a manner similar to those described, herein, in connection with voltages $V_0$ and $V_5$.

For dual-scan panels 2-sets of horizontal compensation values need to be determined and two sets of latches are required. In the example of FIGS. 8A and 8B, the two values for the horizontal compensation are determined within the display controller 20'. These horizontal compensation values can be determined, for example, in accordance with the equation for $V_{HCOMP}$ as set forth under the discussion of Variable "Normal" Voltages herein above. The horizontal compensation value for the next-to-be-scanned row for the upper LCD panel is supplied from pins HU of display controller 20', while the horizontal compensation value for the lower LCD panel is supplied by pins HL.

For the lower LCD panel, digital to analog converters 48 and 50 receive the compensation value from pins HL. It is to be understood that the compensation value represents an offset from the normal $V_0$ and $V_5$, so that digital to analog converter 48 uses the count to "boost" $V_0'$ in a more positive direction, while digital to analog converter 50 uses the count to "boost" $V_5'$ in a more negative direction. D/A converters suitable for use in horizontal compensation boost voltage generation include the operational amplifier/feedback resistor/binary switch circuitry described in FIGS. 15A, 15B, and 16.

It is to be understood that, as with vertical crosstalk compensation, for horizontal crosstalk compensation, VCC is to be separated from $V_0$, for situations where the two are hooked together in the LCD.

Horizontal Setting:

In order to avoid coupling the voltage level from the previous row into the current row, it is preferable that each row start from a relatively consistent level. For purposes of horizontal crosstalk compensation, it is recognized that the horizontal compensation voltage applied to a particular row may be substantially different from that to be applied to the next row, such as when one row has all pixels ON and the next has all pixels OFF. In accordance with the present invention, a settling time is allocated from one row to the next to permit the row excitation voltage to settle to a neutral level. In this manner, the next row in order will receive a starting voltage which will avoid coupling the voltage of the prior row into the current row.

These "settling" times can be provided in several ways. One approach is to allocate an interval at the end of the scanning of a row as a "retrace" interval, and to permit the row driver voltage to settle during this retrace interval. Another alternative is to allocate a portion of the active scanning interval as a "settling" interval. In this case, the level of the excitation voltage would be adjusted so that the amount of energy transferred to the pixels at the voltage level, and for the duration it is present, is sufficient to provide the compensation desired. The selection of the ratio of "boost" voltage duration to "settling" time duration (i.e. normal voltage level) involves trade-offs. The longer the "normal" voltage duration, the better the row to row consistency. However, this means that the boost voltage will need to be higher. On the other hand, the longer the "boost" voltage duration, the lower the boost voltage that is required. However, the longer the "boost" voltage duration in a particular row, the more limited the settling time available, and the greater the difference in voltages across that row compared to adjacent rows. When a CRT timing format is used, such as the IBM PS2™, about 160 pixels times worth of retrace is available for "settling". In accordance with the present invention, it is envisioned that selection of the ratio of "boost" voltage duration to normal voltage duration would involve all of these considerations.

Vertical crosstalk compensation calculation:

As discussed generally above, vertical crosstalk compensation in accordance with the present invention employs 3-sets of information: 1) the number of pixels "on" in a given column; 2) horizontal position of a particular pixel (i.e. column number); and 3) number of transitions from ON-to-OFF or OFF-to-ON in a given column.

"ON" accumulator ($V_{on}u(x)$; $V_{on}l(x)$):

In the preferred embodiment, the "count" of the number of ON pixels in a column, is accomplished without the use of a counter such as that used in the horizontal case ($H_{on}$). The count represents 640-results or counts, with 8 or 9 bits per result or count. These counts are used during the vertical retrace interval.

While 640 latches (and an additional 640 for dual scan panels) could be provided inside the display controller chip to hold these 640 results, the cost would be high. For some types of systems, these additional latches on chip are desireable. But, a less expensive, more flexible alternative (in terms of horizontal resolution) is to use unused portions of the video memory of the display controller. A drawback to this is that this unused memory must get updated for every pixel on the display. For example, when pixel-1 is fetched to be displayed on the LCD, the ACCUMULATOR ($V_{on}(1)$) must be read and incremented in a read modify write (RMW) cycle. Now, pixel-1 occurs 240 times (dual-scan) or 480 (single scan) times during 1-frame time, so, scanning the LCD requires more than 100% more bandwidth. Some practical alternatives to this hurdle are provided herein.

Vertical transitions ($V_tu/V_tl$)

Aside from the bandwidth overhead, counting the ON pixels in a column is straight-forward. Counting the transitions between ON-and-OFF, or OFF-and-ON, requires knowledge of the information from previous lines, performing an XOR with the current line information, and then adding the result to the memory location which keeps track of the TOTAL TRANSITIONS for that column. In the 640 column example, 640 memory locations up to 8 or 9-bits (9-bits for 480-line panels) are provided. Again, for a dual-scan LCD, 640 locations for the upper half and another 640 for the lower half of the LCD are provided.

One alternative is to store this information in a line buffer internal to the display controller 20'. Another alternative is to store the information in some unused portion of video memory. With this latter alternative, the bandwidth increase is similar to the $V_{on}$ bandwidth increase, but, even worse since the previous line information must again be fetched.

The bandwidth requirements present a significant challenge.

Calculate & store:

After the display has been scanned and the data representing the $V_{on}$ and $V_t$ for all 640 columns of the display have been stored in memory, this data is then used to calculate the compensation required for each column according to the relationship:

$$\text{comp}(x)=k1*[V_{on}(x)*(1-k2*x/639)+k3*V_t(x)]$$

where: x is horizontal position (compensation drops-off the greater the distance from the row drivers); $V_{on}$ corresponds to the number of pixels ON in a column (more pixels ON, more compensation required); $V_t$=transitions in a column (more transitions, more compensation required); and k1, k2, and k3 are constants which are panel dependent and supplied via a panel dependent register, e.g. block 53, FIGS. 8A and 8B.

In practice, the above equation describes the general case. Different panels may require different constants or modifications to the above equation. Such different constants or modifications are within the scope of the present invention, it being understood that in accordance with the present invention, the compensation applied to counteract vertical crosstalk effects should take into account the number of pixels which are ON in the column, the number of transitions between ON-and-OFF, and OFF-and-ON, in the column, and the position of the column from the row drivers.

As an example of the application of the above equation to a specific panel, the following equations were used to determine the compensation signals for an LCD panel Model No. LM64148, manufactured by Sharp of Japan.

For $x \leqq 200$:

$$\text{comp}(x) = 0.2 * \left\{ V_{on}(x) * \left[ 1 - 0.00177 * x * \left( 1 - \frac{0.36 * V_t(x)}{V_{on}(x)} \right) \right] + 1.8 * V_t(x) \right\}$$

For $200 < x \leqq 300$:

$$\text{comp}(x) = \left\{ 0.2 - \left[ 0.088 * \left( 1 - \frac{0.4 * V_t(x)}{V_{on}(x)} \right) \right] \right\} * [V_{on}(x) + 1.8 * V_t(x)]$$

For $x > 300$:

$$\text{comp}(x) = \left\{ 0.2 - \left[ 0.1 * \left( 1 - \frac{0.4 * V_t(x)}{V_{on}(x)_u} \right) \right] \right\} * \left\{ V_{on}(x) * \left[ 1 - \frac{0.71 * (x - 300)}{399} \right] * \left( 1 - \frac{0.4 * V_t(x)}{V_{on}(x)} \right) + 1.8 * V_t(x) \right\}$$

The above expression for comp(x) is based upon the assumptions that the LCD has 640 columns, and 240 rows per segment, and that the row drivers drive the LCD panel at the left edge. For LCD panels where the row drivers drive the right edge, the factor (k2*x/639) should be modified to be (k2*((639−x)/639). For panels which drive the rows from both edges, an appropriate adjustment should be made. For example, an expression can be determined empirically which describes the compensation needed for a particular panel as follows. Starting at the left edge of the screen, a column-wise pattern is displayed and crosstalk is produced. Compensation is applied to the remaining columns until the crosstalk is removed. This level of compensation is then recorded. The column-wise pattern is then displayed in the next column, and the required compensation voltage is again determined and recorded for the other columns. The procedure is repeated for the entire panel so that an "x" position versus compensation level curve is obtained. A curve fit is then conducted to determine an expression which best fits the actual data. This expression should then be used to determine the compensation levels applied to counteract crosstalk effects.

In one embodiment, the comp(x) result is 8-bits and is stored in unused video memory. This calculation occurs during the vertical retrace period, therefore, bandwidth is not critical.

While comp(x) described thus far is a function of horizontal position, number of ON pixels, and number of state transitions, it is to be understood that the compensation signal can also take into account temperature variation and input voltage variations. With such an embodiment, temperature information can be provided by a conventional temperature sensor; while input voltage variation can be tracked by a comparator working against a voltage reference.

It is to be understood that depending upon the circumstances, the vertical compensation method and apparatus of the present invention can be sufficient without employing the horizontal crosstalk compensation described herein. For example, a system designer may decide that vertical crosstalk correction is more important or a good enough solution; or horizontal crosstalk may not be sufficiently apparent in the display, such as when the row drivers drive the panel from both edges to lower the loading effects.

As to the former circumstance, the expression set forth herein to determine compensation levels can include an additional term which provides an overall additional "boost" as more column ON bits are included in a given compensation scan line. This additional boost is a function of the number of column ON bits sent to the column drivers during the vertical retrace time. As to the latter circumstance, since the level of horizontal crosstalk is low, only the vertical crosstalk compensation apparatus and methodology need be used.

Some column drivers may exhibit a "local chip loading" phenomena where the voltage droop for a given IC becomes more pronounced as more of its outputs are energized. This effect can be compensated by yet another term in the "comp(x)" expression which would provide additional boost to a group of horizontal pixels depending upon how may pixels of a given column driver are energized.

Send comp(x) data to the panel:

After the comp(x) data has been calculated (over the vertical retrace intervals), this data is sent to the LCD panel and the compensation operates to reduce the vertical crosstalk. Now, since the data for each pixel is 8-bits of compensation while the actual LCD pixel can only be 1-bit (on or off) each of the 8-bit-compensation values is broken up into 8 1-bit blocks and sent to the LCD over 8-retrace scan-lines. See Table 5 hereinabove. For alternative approaches which use more retrace scan-lines, an appropriate grouping of compensation bits are used, e.g. for 16 retrace scan-lines, 16 bits of compensation data are supplied for each column in 16 1-bit blocks.

Fifteen Lines, Sixteen Values:

In the example set forth in FIGS. 12(*a*)–(*e*), fifteen (15) retrace scan-lines are used to provide sixteen (16) compensation values or levels. Table 9 below, illustrates the final value for comp(x) versus what retrace scan-lines of the fifteen available retrace scan-lines are activated for the comp(x) value, and the resulting compensation applied to the column. The resulting applied compensation is expressed in terms of a fraction of the maximum available compensation. It should be appreciated that the values set forth in the "compensation" column of Table 9 are relative values, and that the actual values applied will depend upon the boost voltage levels presented and their duration in each of the retrace scan-lines which are activated.

TABLE 9

| COMP(x) VALUE | RETRACE SCAN-LINE | COMPENSATION |
|---|---|---|
| 0 | All comp. lines contain "0" data | No compensation |
| 1 | Line R1 data active | 1/15 Max Comp. |
| 2 | Line R1–R2 data active | 2/15 Max. Comp. |
| 3 | Line R1–R3 data active | 3/15 Max Comp. |
| 4 | Line R1–R4 data active | 4/15 Max Comp. |
| 5 | Line R1–R5 data active | 5/15 Max Comp. |
| * | * | * |
| * | * | * |
| * | * | * |
| 14 | Line R1–R14 data active | 14/15 Max Comp. |
| 15 | Line R1–R15 data active | Max compensation (15/15) |

The comp(x) values are stored in a 4-bit binary format, thus data sent to the LCD from this binary format would need to be convened before being sent.

One simple scheme to do this is to allow each of the binary bits to control groups of lines, for example, the most significant bit (bit 3), if set, would output a "1" for the first eight retrace scan-lines. Table 10 below illustrates such an assignment:

TABLE 10

| COMP(x) bit | Retrace Scan Line(s) Controlled |
|---|---|
| 0 | R15 |
| 1 | R13–R14 |
| 2 | R9–R12 |
| 3 | R1–R8 |

Table 11 below illustrates the relationship between the compensation value for column "x" ("comp(x) value"), the binary data form of comp(x), the particular retrace scan-lines which are to be active for such comp(x) value, and the actual compensation data bits provided by the display controller to the column drivers.

TABLE 11

| COMP(x) VALUE | BINARY DATA b3 . . . b0 | ACTIVE RETRACE SCAN-LINES | COMPENSATION DATA (R1 . . . R15 |
|---|---|---|---|
| 0 | 0000 | none | 0000 0000 0000 000 |
| 1 | 0001 | R15 | 0000 0000 0000 001 |
| 2 | 0010 | R13–R14 | 0000 0000 0000 110 |
| 3 | 0011 | R13–R15 | 0000 0000 0000 111 |
| 4 | 0100 | R9–R12 | 0000 0000 1111 000 |
| 5 | 0101 | R9–R12, R15 | 0000 0000 1111 001 |
| * | * | * | * |
| * | * | * | * |
| * | * | * | * |
| 11 | 1011 | R1–R8, R13–R15 | 1111 1111 0000 111 |
| * | * | * | * |
| * | * | * | * |
| * | * | * | * |
| 14 | 1110 | R1–R14 | 1111 1111 1111 110 |
| 15 | 1111 | R1–R15 | 1111 1111 1111 111 |

For example, a compensation value of 11 is stored in binary form as the 4-bit sequence: 1011. This 1011 binary sequence causes the corresponding column driver to drive the column with the "boost" voltage during retrace scan-lines R1–R8, and R13–R15, and to drive the column with the normal voltage during retrace scan-lines R9–R12. In turn, the compensation data sent over to that column driver will take the form of 1111 1111 0000 111, with the left-most bit corresponding to R1, and the right-most bit corresponding to R15.

The protocol for transmitting the above compensation data to the column drivers for all 640 columns is illustrated in Table 12 below. For example, the logic state of the compensation data sent to control the application of the boost voltage over the first eight retrace scan-lines is determined by bit 3 (MSB) of the binary data form of comp(x). This is shown in the lines of Table 12 which corresponds to retrace scan lines 1–8. Note that "bit3" is indicated for all such data. Similarly for retrace scan-line 13, bit1 of the comp(x) binary data controls, therefore "comp(x)bit1" is indicated as the source of the logic state of the bits sent to the column drivers.

TABLE 12

| RETRACE SCAN LINE | COMPENSATION DATA SENT TO LCD |
|---|---|
| 1 | comp(0)-bit3, comp(1)-bit3, . . . , comp(639)-bit3 |
| 2 | comp(0)-bit3, comp(1)-bit3, . . . , comp(639)-bit3 |
| 3 | comp(0)-bit3, comp(1)-bit3, . . . , comp(639)-bit3 |
| 4 | comp(0)-bit3, comp(1)-bit3, . . . , comp(639)-bit3 |
| 5 | comp(0)-bit3, comp(1)-bit3, . . . , comp(639)-bit3 |
| 6 | comp(0)-bit3, comp(1)-bit3, . . . , comp(639)-bit3 |
| 7 | comp(0)-bit3, comp(1)-bit3, . . . , comp(639)-bit3 |
| 8 | comp(0)-bit3, comp(1)-bit3, . . . , comp(639)-bit3 |
| 9 | comp(0)-bit2, comp(1)-bit2, . . . , comp(639)-bit2 |
| 10 | comp(0)-bit2, comp(1)-bit2, . . . , comp(639)-bit2 |
| 11 | comp(0)-bit2, comp(1)-bit2, . . . , comp(639)-bit2 |
| 12 | comp(0)-bit2, comp(1)-bit2, . . . , comp(639)-bit2 |
| 13 | comp(0)-bit1, comp(1)-bit1, . . . , comp(639)-bit1 |
| 14 | comp(0)-bit1, comp(1)-bit1, . . . , comp(639)-bit1 |
| 15 | comp(0)-bit0, comp(1)-bit0, . . . , comp(639)-bit0 |

So, if the binary data for comp(1) was the 4-bit word, 1011, with the MSB being the left-most bit and the LSB being the right-most bit, the line in Table 11, corresponding to comp(x)=eleven, indicates the compensation bits sent to the column drivers. This will produce a compensation signal which would be active for the first eight retrace scan-lines, then inactive for the next four retrace scan-lines, and active again for the last 3-lines.

It is to be understood that the above example is one possible protocol for transforming the comp(x) data into compensation data bits for controlling the column drivers, and that other protocols are possible within the scope of the present invention.

Sixteen Lines, Two Voltages, Thirty-One Values:

The following refers to the embodiment of the present invention illustrated in FIGS. 13(*a*)–(*g*), in which 31-compensation values are provided and implemented using various combinations of 16 retrace scan-lines and two different "boost" voltages. In this case, comp(x) will be expressed and stored in terms of a five-bit binary number. Table 13 below, illustrates the final value for comp(x) versus what retrace scan-lines of the sixteen available retrace scan-lines are activated for the comp(x) value, and the resulting compensation applied to the column. The resulting applied compensation is expressed in terms of different combinations of full boost and half boost retrace scan-line periods. Recall the example set forth in Table 6 hereinabove, where one of the retrace scan-lines, e.g. R16, is assigned a half-boost drive voltage, $V_{boost1/2}$, and the remainder are assigned a full-boost drive voltage, $V_{boost}$. Thus, it should be appreciated that the values set forth in the "compensation" column of Table 13 are relative values, and that the actual values applied will depend upon the boost voltage levels presented and their duration in each of the retrace scan-lines which are activated.

TABLE 13

| COMP(x) VALUE | RETRACE SCAN-LINE | COMPENSATION |
|---|---|---|
| 0 | All comp. lines contain "0" data | No compensation |
| 1 | Line R16 data active | ½ |
| 2 | Lines R16, R15 data active | 1½ |
| 3 | Lines R15, R14 data active | 2 |
| 4 | Line R16–R14 data active | 2½ |
| 5 | Line R15–R13 data active | 3 |
| * | * | * |
| * | * | * |
| * | * | * |
| 14 | Lines R16–R9 data active | 7½ |
| 15 | Lines R15–R8 data active | 8 |
| 16 | Lines R16–R8 data active | 8½ |
| * | * | * |
| * | * | * |
| * | * | * |
| 31 | Retrace lines 1–16 active | 15½ (Max compensation) |

Table 13 above illustrates activation of the various retrace scan-lines according to the binary data bit assignments set forth in Table 14.

TABLE 14

| Comp(x) bit | Retrace Scan Line(s) Controlled |
|---|---|
| 0 | R16 |
| 1 | R15 |
| 2 | R13–R14 |
| 3 | R9–R12 |
| 4 | R1–R8 |

Thus, for example, bit 2 of the stored binary data for comp(x) controls the activation of retrace scan-lines R13 and R14, while bit4 controls R1 through R8.

Table 15 below illustrates the relationship between the compensation value for column "x" ("comp(x)"), the binary data form of comp(x), the particular retrace scan-lines which are to be active for such comp(x) value, and the actual compensation data bits provided by the display controller to the column driven.

TABLE 15

| COMP(x) VALUE | BINARY DATA b4 . . . b0 | ACTIVE RETRACE SCAN-LINES | COMPENSATION DATA (R1 . . . R16) |
|---|---|---|---|
| 0 | 00000 | none | 0000 0000 0000 0000 |
| 1 | 00001 | R16 | 0000 0000 0000 0001 |
| 2 | 00010 | R15 | 0000 0000 0000 0010 |
| 3 | 00011 | R15–R16 | 0000 0000 0000 0011 |
| * | * | * | * |
| * | * | * | * |
| * | * | * | * |
| 11 | 01011 | R9–R12, R15–R16 | 0000 0000 1111 0011 |
| * | * | * | * |
| * | * | * | * |
| * | * | * | * |
| 15 | 01111 | R9–R16 | 0000 0000 1111 0011 |

TABLE 15-continued

| COMP(x) VALUE | BINARY DATA b4 . . . b0 | ACTIVE RETRACE SCAN-LINES | COMPENSATION DATA (R1 . . . R16) |
|---|---|---|---|
| 16 | 10000 | R1–R8 | 1111 1111 0000 0000 |
| * | * | * | * |
| * | * | * | * |
| * | * | * | * |
| 23 | 10111 | R1–R8, R13–R16 | 1111 1111 0000 1111 |
| * | * | * | * |
| * | * | * | * |
| * | * | * | * |
| 31 | 11111 | R1–R16 | 1111 1111 1111 1111 |

The transmission of the above compensation data to the column drivers for all 640 columns is illustrated in Table 16 below. For example, the logic state of the compensation data sent to control the application of the boost voltage over the first eight retrace scan-lines is determined by bit4 (MSB) of the binary data form of comp(x). This is shown in the lines of Table 16 which corresponds to retrace scan lines 1–8. Note that "bit4" is indicated for all such data. Similarly for retrace scan-line 13, bit2 of the comp(x) binary data controls, therefore "comp(x)-bit2" is indicated as the source of the logic state of the bits sent to the column drivers.

TABLE 16

| RETRACE SCAN LINE | COMPENSATION DATA SENT TO LCD |
|---|---|
| 1 | comp(0)-bit4, comp(1)-bit4, . . . , comp(639)-bit4 |
| 2 | comp(0)-bit4, comp(1)-bit4, . . . , comp(639)-bit4 |
| 3 | comp(0)-bit4, comp(1)-bit4, . . . , comp(639)-bit4 |
| 4 | comp(0)-bit4, comp(1)-bit4, . . . , comp(639)-bit4 |
| 5 | comp(0)-bit4, comp(1)-bit4, . . . , comp(639)-bit4 |
| 6 | comp(0)-bit4, comp(1)-bit4, . . . , comp(639)-bit4 |
| 7 | comp(0)-bit4, comp(1)-bit4, . . . , comp(639)-bit4 |
| 8 | comp(0)-bit4, comp(1)-bit4, . . . , comp(639)-bit4 |
| 9 | comp(0)-bit3, comp(1)-bit3, . . . , comp(639)-bit3 |
| 10 | comp(0)-bit3, comp(1)-bit3, . . . , comp(639)-bit3 |
| 11 | comp(0)-bit3, comp(1)-bit3, . . . , comp(639)-bit3 |
| 12 | comp(0)-bit3, comp(1)-bit3, . . . , comp(639)-bit3 |
| 13 | comp(0)-bit2, comp(1)-bit2, . . . , comp(639)-bit2 |
| 14 | comp(0)-bit2, comp(1)-bit2, . . . , comp(639)-bit2 |
| 15 | comp(0)-bit1, comp(1)-bit1, . . . , comp(639)-bit1 |
| 16 | comp(0)-bit0, comp(1)-bit0, . . . , comp(639)-bit0 |

If, for example, the binary data for comp(1) was the 5-bit word, 10111, with MSB being the left-most bit and LSB being the right-most bit, the line in Table 15, corresponding to comp(x)=twenty-three (23), indicates the compensation bits sent to the column drivers. This will produce a compensation signal which would be active for the first eight retrace scan-lines, then inactive for the next four retrace scan- lines, and active again for the last 4 lines.

It is to be understood that the above example is but one possible protocol for transforming the five-bit binary comp (x) data into compensation data bits for controlling the column drivers, and that other protocols are possible within the scope of the present invention.

Practical Implementations:

Conventional crosstalk removal techniques to date have been too expensive to gain wide spread acceptance by LCD manufacturers. It is important that the implementation of crosstalk compensation be as inexpensive as possible while still providing substantial improvement.

Three possible implementations will now be described: 1) HIGH END—higher cost/performance; 2) MID RANGE; and 3) LOW END—lower cost/performance. The high-end implementation employs display controller calculation of the vertical ON ($V_{on}$) and vertical transition ($V_t$) quantities, and buffers within the display controller chip to store such quantities. This provides a high performance solution capable of full-motion video. However, because additional on-chip circuitry is used, this implementation is the more expensive.

The mid-range implementation again employs display controller calculation of $V_{on}$ and $V_t$, has a small mount of internal buffer storage on-chip, but stores the $V_{on}$ and $V_t$ data in memory, such as unused portions of video memory (VMEM 110, FIGS. 8A and 8B), or system memory, or other available memory. This implementation does not update in real time, but often enough for most applications. It is expected that a degradation in performance of about 10% will result because updates are not in real time, and that such degradation may be most noticeable in displaying of live-video information.

The low-end implementation uses the CPU to perform the calculations. Performance is expected to degrade. This will most likely limit the use of this implementation to "layered" applications, such as Microsoft WINDOWS™, which would allow these calculations to be performed as a part of a software driver supplied with the display controller.

The mid-range implementation is currently preferred.

Mid Range Solution Implementation:

As discussed earlier, using the unused portions of video memory, VMEM, can place very high bandwidth demands on the video memory. Performance can suffer because the CPU will have fewer time-slots to access VMEM. To overcome this problem some trade-offs are made:

1) Compensation values are not calculated in real-time;
2) A partial line buffer within the display controller allows intermediate calculations of $V_{on}$ and $V_t$ to occur without constant RMW cycling to VMEM, and only the final results are stored in VMEM;
3) A full-screen bit image is employed in screen memory. This image represents the actual "ON/OFF" state of the screen for a particular frame period.

While the vertical compensation determination requires that an entire screen bit-image be evaluated, since the determination is not "real-time" it is not mandatory that the entire screen bit-image be available at any given time. Thus, it is within the scope of the present invention to provide vertical compensation even when less than a full screen bit-image is available at a given time, such as with a half-frame buffer configuration, or a line buffer configuration.

Real Time Update:

In the mid-range implementation, it is estimated to take somewhere between 3–10 frames to completely process a screen of display data to determine $V_{on}$ and $V_t$. This means when an image changes, crosstalk will occur for up to 10-frames before all columns are compensated.

Partial Line Buffer:

Currently, it is preferred that all of the calculations be performed during the vertical retrace interval and that the vertical retrace will be compatible to the IBM PS2™ CRT timing, i.e. 43 scan-lines of retrace. It may be possible to do some of the processing during the horizontal retrace, the active screen, and even during the compensation intervals, thus, much more of the calculation may be performed during each frame by utilizing display controller resources during these other intervals. However, in order to keep the present explanation simple it will be assumed that only the 27 scan-lines of vertical retrace time will be used for calculations. It is to be understood that the present invention is equally applicable to other CRT timing formats, and other retrace intervals, and that it is not critical to satisfactory practice of the present invention that compatibility with a particular CRT timing format be provided.

Table 17 provides a pseudo code listing of the calculations which are performed to determine $V_{on}$ and $V_t$:

TABLE 17

```
CLEAR previous
for COLUMN = 0 to 40 step 16        'Assume we read 16-pixels/read on a
                                    '640 column LCD;
CLEAR PACC                          'Start new column with "0";
CLEAR TACC                          Start a new column with "0";
for LINE = 0 to 239                 'Assume a 480-line dual-scan LCD;
temp = READ (LINE,COLUMN)           'get 16-pixels from the grayscaled
                                    'full-frame memory;
for x = 0 to 15                     'process the 16-pixels obtained with
                                    'the 1-read;
pix(x) = bit(temp,x)                'separate the 16-bits into individual
                                    'pixels;
                                    'the value is either 1 'or 0 (on or off
                                    'pixel);
PACC(x) = PACC(x) + pix(x)          'Running total of # pixels ON in
                                    'a column;
trans = previous(x) (xor) pix(x)    'if the previous lines pixel was the
                                    'same, then transition = 0, else
                                    '1;
TACC(X) = TACC(X) + trans           'Running total of # transitions in
                                    'a column;
previous(x) = pix(x)                'this line is now "history", it will be
                                    'used next time;
next x                              '
next LINE                           '
                                    'at this point, the 16-byte internal
                                    'registers (PACC(x) and TACC(x))
                                    'contain the final value for the entire
                                    'column of 16-pixels;
                    'the amount of compensation is determined next:
for x = 0 to 15
comp(x) = k1 * [PACC(x) * (1 - k2 * x/639) + k3 * TACC(x))]
address = COMPADDR * 640 + COLUMN*16 + x
data = comp(x)                      '
WRITE (address,data)                'store it in VMEM;
next x                              '
next COLUMN                         'Do all 40 16-pixel columns;
```

The actual processing is performed over several frames, since the 27-retrace scan-lines available for processing in one frame is not enough time. The columns can be grouped into "chunks" of 10-columns, for example, so that the processing is completed over four frames. This assumes 16-pixel columns, so that ten such columns represents 160-pixels columns.

The total number of memory accesses needed to calculate the compensation for one panel of a dual-panel LCD is:

TotReads=240ROWS*40COLUMNS(16pix/col)

=9600 Random Reads

TotWrite=640 Random Writes

TotAccess=TotReads+TotWrite=9600+640=10,240.

Now, the same number of accesses applies for the other half of the LCD, so this number is actually doubled to 10,240×2=20,480.

A 640×480 LCD screen refresh requires 307,200 cycles (assuming 8-bit/pixel mode), so this 20,480 extra cycles requires only 7% more overhead (if done in one refresh period). If this is spread over, 4-refresh periods, for example, then, the overhead is only about 2%.

As discussed above, the present invention can be implemented through several simple modifications to the VGA (or any) controller, the LCD panel and the interface between the controller and panel.

CPU Based Compensation Determination:

A lower cost alternative to either the full or partial line buffer approaches is to allow the CPU to perform the required calculations for the vertical compensation, and to store the results in an unused portion of video memory 110. See FIGS. 8A and 8B. Aside from the lower cost advantage that this approach has, many aspects of "real-time" compensation are actually improved using this approach since the program code for performing this compensation calculation resides in the same driver which is responsible for updating the video memory image. This means that as the video memory is updated, the compensation calculation can also be performed. For example, since the driver has the task of updating the video memory, it will know when transitions are to occur in the rows and columns, the position of the pixel in which the transition is occurring, and have available to it the information needed to determine the number of pixels which are ON in a row or column. Rather than a separate, independent module, the compensation calculation can be incorporated as a part of the driver function.

Even given this "pseudo" real-time compensation, there are still events which occur on a "static" display. In particular, grayscaled pixels on passive LCD panels are produced by MODULATING a pixel ON and OFF over many frame updates to produce what appears to the eye as an intermediate shade(s) of gray. In a pure hardware implementation the computation occurs in real-time, and the fact that the pixels on the screen are "gray-scaled" (i.e., being turned on/off over frame times to provide an illusion to a grayshade), the result stored in the accumulator will be roughly the same from frame-to-frame. Reference is made to U.S. Pat. No. 5,185,602, entitled METHOD AND APPARATUS FOR PRODUCING THE PERCEPTION OF HIGH QUALITY GRAYSCALE SHADING ON DIGITALLY COMMANDED DISPLAYS, assigned to the assignee of the present application, and incorporated herein by reference, in which one grayscale method and apparatus are described.

When grayscales are involved, the CPU may not be able to directly determine when such a grayscaled pixel is on or off. As such, a "probability" is assigned to the state of the pixel being "on" based on the grayscale value stored in the video memory. For example, a pixel stored as "1011" in video memory may represent a grayscale of 11/16. This 11/16 grayscale intensity is sometimes a "0" (off) on the display and sometimes a "1" (on), but, it is "more often 1". Therefore, for computational purposes, it is assigned an 11/16 probability, and 11/16 is the quantity which is summed with the probability of the other grayscaled pixels to obtain the total number of ON pixels in the column.

If for example 16 such pixels in a column or row were encountered with this 11/16 grayscale, the result for those 16-pixels would be 11/16+11/16+ . . . 11/16=11. In other words, the column would be deemed to have 11 ON pixels.

Counting "transitions" proceeds in a similar manner. However a transition from 11/16 to 11/16 will result in "0" which is not true, so, for the case where pixels have the same gray scale value, some knowledge of the way the grayscale is implemented must be used in the crosstalk compensation determination. For example, in U.S. Pat. No. 5,185,602, determination of the actual transitions will depend on the grayscale waveform, patterns, line offset, and matrix size. Thus, the position of a pixel within the grayscale matrix will determine whether it is ON or OFF.

It is to be understood that the grayscale value stored in video memory has other functions appearing in the data path to the grayscale modulation circuit. Items normally encountered include PALETTE RAMS and REVERSE VIDEO, or other such "remappers". The CPU must also evaluate these other items to determine exactly the final grayscale which is to be displayed.

Interface Requirements:

For a typical dual-scan mono LCD, identical sets of interface pins are provided by the display controller for each half of an LCD panel (one set for the upper half of the panel and one for the lower half). Single scan panels which have only one set of column drivers (there are some 640×480 mono LCDs which are either 4-bit or 8-bit data interfaces which have the drivers data-bus connected together) are provided only 1-set of control pins.

The modifications to the interface need not change between color and monochrome LCD displays. It should be noted, however, that many color LCDs will have a different data interface than mono displays and thus, there may be differences in the interface requirements between mono and color displays, but, the differences are due to the data interface and not because of color or mono nature of the display.

As mentioned earlier, single scan mono LCDs have only one set of data drivers and thus are provided only 1-set of control signals. Single scan color LCDs usually have dual-data paths to provide easier interconnection to the 3-fold increase in data lines (to support RGB pixel arrangement). As a result, many single scan LCDs (ie: color STN single scan) will have separate drivers for "even/odd" pixels. The data bus on these panels are typically split (either dual-4-bit or dual-8-bit). Even though there are the additional drivers (and data bus lines), only 1-set of control signals are required (same as single scan monochrome).

In the preceding description, these drivers (and data lines) may have been referred to as "Upper" and "Lower". This convention is used by the panel manufacturers because this describes the physical location of the drivers and NOT to be confused with dual scan panels. This convention of "Upper and Lower" was used (when appropriate) when discussing single scan color LCDs, but, it is to be understood that "even/odd" physical pixels of the display of a single scan color LCD are being controlled.

The crosstalk removal technique of the present invention is also applicable to the newer "Active Addressing" technique of InFocus/Motif of Oregon, or the "Multiple Line Scan" technique of Optrex of Japan.

This technique is also directly applicable to TFD (thin film diode) types of active matrix LCDs, and the vertical compensation technique may also be employed on TFT (thin film transistor) types of displays, which may allow simple frame modulation (to prevent DC operation) to be employed (instead of line and pixel inversion), and thus saving significant power in the column drivers.

Additional control registers:

As mentioned earlier, 4 new registers are provided to supply the panel dependent constants used in the compensation equation:

TABLE 18

| REGISTER | DESCRIPTION |
|---|---|
| XTk1 | crosstalk constant, k1, for TOTAL PIXELS |
| XTk2 | crosstalk constant, k2, for HORIZON. POSITION |
| XTk3 | crosstalk constant, k3 for TRANSITIONS |
| CALCADDR | starting address location of unused VMEM where the compensation data are stored. |

It is possible to "hard-wire" any of these registers when programmability is not a requirement.

PWM circuitry:

As discussed above, one embodiment of the present invention uses pulse width modulation (PWM) to operate like a D/A to finely tune the required compensation voltage to the LCD. This allows for a much simpler interface to the LCD, fewer pins on the interface and save the expense of a D/A converter on the LCD (2 for dual scan). Similar PWM circuitry can be used for both upper and lower panels (for dual scan panels) and can also be used for both horizontal and vertical crosstalk corrections, although separate voltage generators are preferred for the each of the panels when correcting horizontal crosstalk.

Yet another preferred embodiment of the present invention involves the use of the column data lines from the display controller as the HU and HL lines for the D/A converters. Data for the D/A converters can be sent by the display controller at the end of the scan line. A latch can then hold this value for the D/A for the entire duration of the active scan-line.

Other Implications:

The present invention has the potential of improving the operation of an LCD panel to the point that extremely high refresh rates to the LCD to raise contrast ratios may now be practical. In the past, the use of high refresh rates was so prone to crosstalk that it has not been given much attention. However, the crosstalk removal technique of the present invention could enable this high refresh addressing method to achieve the same contrast ratio performance as Active Addressing and MLS techniques, but with: simpler logic, low impact to LCD vendors, allows use of current STN column drivers, lower power and cost, and an easy grayscale implementation.

Dark Crosstalk:

The crosstalk appearance on an LCD is usually adjusted by the LCD manufacturer to provide the best overall appearance or the best appearance for display images which are most often encountered for the types of information intended for a particular application of the LCD. This adjustment can be accomplished in a variety of ways, but, for purposes of illustration, one technique will be discussed herein.

The non-select voltages for the row and column drivers ($V_1/V_4$ and $V_2/V_3$, respectively) are normally set such that for non-selected pixels on the display the same absolute voltage will be applied to the pixels. That is:

$$abs[V_0(\text{column})-V_1(\text{row})]=abs[V_2(\text{column})-V_1(\text{row})].$$

For $V_0=0$ V, $V_1=1$ V, and $V_2=2$ V, the expression becomes:

$$abs[0-1]=abs[2-1],$$

or $$1=1.$$

Since it is desired to make crosstalk appear "darker" than normal, $V_2$(column) can be increased slightly. This will cause the pixels in non-selected columns in non-selected rows to be brighter than the selected pixels in non-selected rows, thereby causing the ON column to make a "dark" shadow in these non-selected rows.

For non-selected pixels in a row that is being selected normally, the situation is:

$$V_{scan_pix_off}=abs[V_0(\text{column})-V_5(\text{row})]-abs[V_2(\text{column})-V_5(\text{row})].$$

For $V_5=17$ V, $V_2=2$ V, and $V_0 0$ V, the expression becomes:

$$V_{scan_pix_off}=abs[0-17]-abs[2-17],$$

or $$V_{scan_pix_off}=15.$$

But, because $V_2$ is slightly higher than "normal", instead of 15 V, a level which is less than 15 V appears across the pixels which causes them to also be darker than usual.

The above discussion also applies when the opposite values, $V_5$, $V_4$, and $V_3$, are used for the scanning of the LCD.

The example provided above entails the forcing of OFF pixels to be slightly brighter than "ON" columns and allows the vertical compensation to always "add" voltages to columns, instead of "subtracting" voltages.

It is to be understood that while the present invention has been described in connection with crosstalk compensation in liquid crystal display systems, the present invention can be used with any matrix scanned device where production of or reception of accurate voltages is required.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed.

We claim:

1. Apparatus for reducing crosstalk by compensating individual columns in liquid crystal display systems of the type in which column drivers and row drivers apply excitation voltages to pixels arranged in rows and columns in a liquid crystal display panel, comprising first means for determining for an individual column a column compensation value including the number of transitions in excitation voltage between first and second designated conditions within the individual column; and second means for applying to the individual column a column compensating signal which is a function of the column compensation value for the individual column.

2. The apparatus of claim 1 wherein the column compensation value determined by the first determining means further includes the number of pixels having the first designated condition in the individual column.

3. The apparatus of claim 1 wherein the column compensation value determined by the first determining means further includes the position of the individual column in the liquid crystal display panel.

4. The apparatus of claim 1 further including means for reducing crosstalk by compensating individual rows, said means comprising:

third means responsive to the number of pixels having a third designated condition in an individual row; and fourth means for applying to the individual row a row compensating signal which is a function of the number of pixels having the third designated condition in the individual row.

5. The apparatus of claim 1 wherein the second means is adapted to apply the column compensating signal to the individual column during a vertical retrace period of the liquid crystal display system.

6. The apparatus of claim 5 wherein the column compensating signal applied by the second means is a predetermined boost voltage applied to the individual column over a designated period during the vertical retrace period.

7. The apparatus of claim 6 wherein the designated period is selected from a plurality of periods in the vertical retrace period of different lengths of time.

8. The apparatus of claim 7 wherein the designated period is a combination of selected ones of the plurality of periods of different lengths of time.

9. The apparatus of claim 6 wherein the vertical retrace period is apportioned into a plurality of retrace scan-line intervals and the column compensating signal is applied during the retrace scan-line intervals.

10. The apparatus of claim 9 wherein the predetermined boost voltage is present over the plurality of retrace scan-line intervals, and the second means applies the predetermined boost voltage to the individual column for a selected number of the plurality of retrace scan-line intervals which is a function of the column compensation value.

11. The apparatus of claim 10 wherein the predetermined boost voltage is provided to the column driver for a predetermined interval during which the predetermined boost voltage is permitted to settle, and subsequent to which the predetermined boost voltage is applied by the second means to the individual column.

12. The apparatus of claim 6 wherein the column compensating signal includes a number of column ON bits which are sent during the vertical retrace period, and the column compensation value further includes an additional boost factor which is a function of the number of column ON bits sent.

13. The apparatus of claim 5 wherein the column compensating signal applied by the second means is formed from a plurality of predetermined boost voltages applied to the individual column during the vertical retrace period.

14. The apparatus of claim 13 wherein the second means applies to the individual column selected ones of the plurality of predetermined boost voltages during different portions of the vertical retrace period.

15. The apparatus of claim 14 wherein the vertical retrace period is apportioned into a plurality of retrace scan-line intervals and different ones of the plurality of predetermined boost voltages are presented for application to the individual column during different ones of the plurality of retrace scan-line intervals.

16. The apparatus of claim 15 wherein each of the plurality of predetermined boost voltages is provided to the column driver for a predetermined interval during which settling of the boost voltage is permitted to occur, and subsequent to which the each of the plurality of predetermined boost voltages can be applied by a column driver to the individual column.

17. The apparatus of claim 13 further including column drivers adapted to receive normal excitation voltages and a boost voltage, and responsive to a select signal from the second means so that the boost voltage is applied by the column drivers to associated individual columns when the select signal is present.

18. The apparatus of claim 1 wherein the column compensation value includes an adjustment for temperature.

19. The apparatus of claim 1 wherein the liquid crystal display system is powered from an input power supply voltage and further wherein the column compensation value includes an adjustment for variations in the input power supply voltage.

20. The apparatus of claim 3 wherein a liquid crystal panel in a liquid crystal display system can be characterized by a number of panel dependent constants which are a function of the response characteristics of the panel, and further wherein the second means includes means responsive to the column compensation value and the panel constants for generating compensation data for the individual column; and means responsive to the compensation data for converting the compensation data into the column compensating signal.

21. The apparatus of claim 20 wherein the compensation data generated by the compensation data generating means designates at least one time period from a plurality of time periods of different lengths.

22. The apparatus of claim 21 wherein the converting means includes means for generating a compensating voltage having a predetermined level; and means for applying the compensating voltage to the individual column during the time periods designated by the compensation data from the plurality of time periods.

23. The apparatus of claim 22 wherein the column compensating signal is applied to the individual column during a plurality of compensating scan line periods occurring in a vertical retrace period, and further wherein a boost voltage is presented to a column driver during each of the plurality of compensating scan line periods; and wherein the compensation data is supplied to the column driver as display data, and comprises a plurality of bits, each of which corresponds to one of the plurality of compensating scan line periods, so when a bit corresponding to a particular compensating scan line period has a predetermined logic state, the column driver applies the boost voltage to the individual column over the time the boost voltage is present in the particular compensating scan-line period.

24. The apparatus of claim 23 wherein the compensation data is determined according to the expression $$\mathrm{COMP}(x) = k1 * \left[ Von(x) * \left( 1 - \frac{k2 * x}{C} \right) + k3 * Vt(x) \right]$$

wherein, x=horizontal position of the individual column;

COMP(X)=the compensation data;

Von(x)=number of pixels in the first designated condition in the individual column;

Vt(x)=number of transitions between the first designated and second designated conditions, and vice versa, in the individual column;

k1=horizontal position constant;

k2=ON pixel constant;

k3=transition constant; and

C=the number of columns in the panel.

25. The apparatus of claim 23 wherein there are N compensating scan lines numbered 1 through N, and the time period associated with a particular one of the N compensating scan lines has a duration, PD, determined according to the expression $$PD = \frac{C - 2^M}{2^L}$$

wherein PD is expressed in number of pixels periods;

C=the number of columns in the panel;

M=an integer less than N; and

L=the compensating scan line number.

26. The apparatus of claim 20 wherein the compensation data designates a magnitude, and the converting means is a digital to analog converter so that the magnitude of the column compensating signal is designated by the compensation data.

27. The apparatus of claim 4 wherein the row compensating signal applied by the fourth means is a predetermined boost voltage applied over a designated period during the active scanning of an individual row.

28. The apparatus of claim 27 wherein the designated period has a duration which is selected as a function of the number of pixels in the individual row having the third designated condition.

29. The apparatus of claim 28 further including row drivers adapted to receive normal excitation voltages and a boost voltage, and responsive to a select signal from the fourth means so that the boost voltage is applied by the row drivers to associated row when the select signal is present.

30. The apparatus of claim 4 wherein the row compensating signal includes an adjustment for temperature.

31. The apparatus of claim 4 wherein the liquid crystal display system is powered from an input power supply voltage and further wherein the row compensating signal includes an adjustment for variations in the input power supply voltage.

32. The apparatus of claim 4 wherein the row compensating signal is provided to the row driver for a predetermined interval following which a normal voltage is applied to the row driver over a settling interval prior to the scanning of a row which is subsequent to the individual row.

33. The apparatus of claim 4 wherein the row compensating signal is applied during an active scanning time of the individual row.

34. The apparatus of claim 4 wherein the row compensating signal is also a function of the column compensation value, and is applied during an active scanning time of the individual row and during a vertical retrace period of the liquid crystal display panel.

35. Apparatus for reducing crosstalk by compensating individual rows in liquid crystal display systems of the type in which column drivers and row drivers apply excitation voltages to pixels arranged in rows and columns in a liquid crystal display panel, comprising counting means for determining the number of pixels having an ON condition in an individual row;

compensation means for applying to the individual row a row compensating signal which is a function of the number of pixels having the ON condition in the individual row, wherein the row compensating signal applied by the compensation means is a predetermined boost voltage applied over a designated period during the active scanning of the individual row to provide a settling interval such that coupling the voltage of the individual row into a next individual row is avoided; and a row driver adapted to receive normal excitation voltages and a boost voltage, and responsive to a select signal from the compensation means so that the boost voltage is selectively applied by the row driver to the associated individual row when the select signal is present.

36. The apparatus of claim 35 wherein the designated period has a duration which is selected as a function of the number of pixels having the ON condition in the individual row.

37. The apparatus of claim 36 wherein the compensation means comprises a D/A converter responsive to the number of pixels having the ON condition in the individual row, and further responsive to an offset which is a function of the distance of the individual row from the column drivers.

38. Apparatus for reducing crosstalk by compensating individual rows in liquid crystal display systems of the type in which column drivers and row drivers apply excitation voltages to pixels arranged in rows and columns in a liquid crystal display panel, comprising counting means for determining the number of pixels having an ON condition in an individual row;

compensation means for applying to the individual row a row compensating signal which is a function of the number of pixels having the ON condition in the individual row, wherein the row compensating signal applied by the compensation means is a selected boost voltage applied over a designated period during the active scanning of a row; and further wherein the row compensating signal is provided to the row driver for a predetermined interval which is followed by a normal voltage which is applied to the row driver over a settling interval prior to the scanning of a subsequent row such that coupling the voltage of the current row into the subsequent row is avoided.

39. Apparatus for reducing cross talk by compensating individual columns and individual rows in liquid crystal display systems of the type in which column drivers and row drivers apply excitation voltages to pixels arranged in rows and columns, comprising first means for determining a column compensation value for a designated condition within an individual column;

second means for applying to the individual column a column compensating signal which is a function of the compensation value for the individual column;

third means for generating a count signal indicative of the number of pixels having a designated condition in an individual row; and fourth means for applying to the individual row a row compensating signal in response to the count signal.

40. The apparatus of claim 39 wherein the column compensation value is a function of the distance of the column from the row drivers.

41. The apparatus of claim 39 wherein the column compensation value is a function of the number of pixels in a first logic state within the individual column.

42. The apparatus of claim 39 wherein the third means determines the number of ON pixels in the individual row, prior to the individual row being scanned.

43. The apparatus of claim 42 wherein the fourth means is a digital to analog converter.

44. The apparatus of claim 42 wherein the fourth means provides a "boost" voltage to a row being scanned for a selected interval of time.

45. The apparatus of claim 39 wherein the column compensation value includes an adjustment for temperature.

46. The apparatus of claim 39 wherein the liquid crystal display system is powered from an input power supply voltage and further wherein the column compensation value includes an adjustment for variations in the input power supply voltage.

47. The apparatus of claim 39 wherein the row compensating signal includes an adjustment for temperature.

48. The apparatus of claim 39 wherein the liquid crystal display system is powered from an input power supply voltage and further wherein the row compensating signal includes an adjustment for variations in the input power supply voltage.

49. The apparatus of claim 39 wherein the column compensation value increases as a function of increasing distance of the column from the row drivers.

50. Apparatus for reducing cross talk by compensating individual columns and individual rows in liquid crystal display systems of the type in which column drivers and row drivers apply excitation voltages to pixels arranged in rows and columns, comprising:

first means for determining a column compensation value for a designated condition within an individual column;

second means for applying to the individual column a column compensating signal which is a function of the compensation value for the individual column;

third means responsive to the number of pixels having a designated condition in an individual row; and fourth means for applying to the individual row a row compensating signal which is a function of the number of pixels having the designated condition in the individual row wherein the column compensation value is a function of the number of transitions in states of the pixels in the individual column.

51. A display controller for controlling liquid crystal display systems of the type in which column drivers and row drivers apply excitation voltages to pixels arranged in rows and columns whereby crosstalk is reduced by compensating individual columns and individual rows, comprising first means for determining a column compensation value for an individual column which is a function of pixels states in the individual column;

second means for applying to the individual column a column compensating signal which is a function of the column compensation value for the individual column;

third means for generating a count signal indicative of the number of pixels having a designated condition in an individual row; and fourth means for applying to the individual row a row compensating signal in response to the count signal.

52. Apparatus for reducing crosstalk in liquid crystal display systems of the type in which column drivers and row drivers apply excitation voltages to pixels arranged in rows and columns in a liquid crystal display panel, wherein the liquid crystal panel can be characterized by panel dependent constants k1, k2, and k3 which are a function of the response characteristics of the panel, the apparatus comprising first means for determining for a column a compensation value including the number of transitions in excitation voltage between first and second designated conditions and the position of the column in the liquid crystal display panel; and second means for applying to the column a column compensating signal which is a function of the compensation value for the column, the second means including means responsive to the compensation value and the panel dependent constants for generating compensation data for the column according to the expression $$COMP(x) = k1 * \left[ Von(x) * \left( 1 - \frac{k2 * x}{C} \right) + k3 * Vt(x) \right]$$

wherein, x=horizontal position of the column;

COMP(X)=the compensation data;

Von(x)=number of pixels in the first designated condition in the column;

Vt(x)=number of transitions between the first designated and second designated conditions, an vice versa, in the column;

k1=horizontal position panel dependent constant;

k2=ON pixel panel dependent constant;

k3=transition panel dependent constant; and

C=the number of columns in the panel the compensation data designating at least one time period from a plurality of time periods of different lengths; and means responsive to the compensation data for converting the compensation data into the column compensating signal, the converting means including means for generating a compensating voltage having a predetermined level; and means for applying the compensating voltage to the column during the time periods designated by the compensation data from the plurality of time periods wherein the column compensating signal is applied to the column during a plurality of compensating scan line periods occurring in a vertical retrace period, and further wherein a boost voltage is presented to the column driver during each of the plurality of compensating scan line periods; and wherein the compensation data is supplied to the column driver as display data, and comprises a plurality of bits, each of which corresponds to one of the plurality of compensating scan line periods, so when a bit corresponding to a particular compensating scan line period has a predetermined logic state, the column driver applies the boost voltage to the column over the time the boost voltage is present in the particular compensating scan-line period.

53. The apparatus of claim 52 wherein the compensation value is determined by a display controller operating under program control.

54. The apparatus of claim 53 wherein the display controller includes a full-line buffer so that the compensation value can be determined by the display controller without access to external memory.

55. The apparatus of claim 53 wherein the display controller includes a partial-line buffer, and further including an external memory so that the compensation value can be determined by the display controller with limited resort to the external memory.

56. The apparatus of claim 52 wherein the liquid crystal display system communicates with a central processing unit, and further wherein the compensation value is determined by the central processing unit operating under program control.

57. The apparatus of claim 56 wherein the liquid crystal display includes means for displaying gray scale pixel intensities, and further wherein the compensation value is determined by the central processing unit as a part of a display driver program.

58. The apparatus of claim 57 wherein the central processing unit utilizes information about the manner in which a grayscale is implemented to form the count of the number of pixels which are ON in a column.

59. The apparatus of claim 57 wherein the central processing unit utilizes information about the manner in which a grayscale is implemented when determining the number of transitions in a column in which the one and the different gray scale states are present.

60. Apparatus for reducing crosstalk in liquid crystal display systems of the type in which column drivers and row drivers apply excitation voltages to pixels arranged in rows and columns in a liquid crystal display panel, wherein the liquid crystal panel can be characterized by panel dependent constants k1, k2, and k3 which are a function of the response characteristics of the panel, the apparatus comprising first means for determining for a column a compensation value including the number of transitions in excitation voltage between first and second designated conditions and the position of the column in the liquid crystal display panel; and second means for applying to the column a column compensating signal which is a function of the compensation value for the column, the second means including means responsive to the compensation value and the panel constants for generating compensation data for the column, the compensation data designating at least one time period from a plurality of time periods of different lengths; and means responsive to the compensation data for converting the compensation data into the column compensating signal, the converting means including means for generating a compensating voltage having a predetermined level; and means for applying the compensating voltage to the column during the time periods designated by the compensation data from the plurality of time periods wherein the column compensating signal is applied to the column during a plurality of compensating scan line periods occurring in a vertical retrace period and there are N compensating scan lines numbered 1 through N, and the time period associated with a particular one of the N compensating scan lines has a duration, PD, determined according to the expression $$PD=(C-2^{M})/2^{L}$$

wherein second means for applying to the individual column a column compensating signal which is a function of the compensation value of the individual column;

third means responsive to the number of pixels having a designated condition in an individual row; and fourth means for applying to the individual row a row compensating signal which is a function of the number of pixels having a designated condition in the individual row wherein the column compensation value is a function of the number of transitions in states of the pixels in the individual column.

* * * * *

UNITED STATES PATENT AND TRADEMARK OFFICE

CERTIFICATE OF CORRECTION

PATENT NO. : 5,670,973
DATED : SEPTEMBER 23, 1997
INVENTOR(S) : CHESTER FLOYD BASSETTI, JR., et al.

It is certified that error appears in the above-identified patent and that said Letters Patent is hereby corrected as shown below:

In Col. 36, line 59, please delete "an" and insert in place thereof --and--;

In Col. 38, please delete lines 43 through 54 and insert in place thereof:

--PD is expressed in number of pixel periods;
C = the number of columns in the panel;
M = an integer less than N; and
L = the conpensating scan line number, and further wherein a boost voltage is presented to the column driver during each of the plurality of compensating scan line periods; and wherein the compensation data is supplied to the column driver as display data, and comprises a plurality of bits, each of which corresponds to one of the plurality of compensating scan line periods; so when a bit corresponding to a particular compensating scan line period has a predetermined logic state, the column driver applies the boost voltage to the column over the time the boost voltage is present in the particular compensating scan-line period.--

Signed and Sealed this

Twenty-seventh Day of January, 1998

*Attest:*

Bruce Lehman

BRUCE LEHMAN

*Attesting Officer*

*Commissioner of Patents and Trademarks*